US006010652A

United States Patent [19]

Yoshida

[11] Patent Number: 6,010,652

[45] Date of Patent: Jan. 4, 2000

[54] THREE-DIMENSIONAL WOVEN FABRIC STRUCTURAL MATERIAL AND METHOD OF PRODUCING SAME

[75] Inventor: Shigeru Yoshida, Kyoto, Japan

[73] Assignee: Unitika Glass Fiber Co., Ltd., Kyoto, Japan

[21] Appl. No.: 09/047,135

[22] Filed: Mar. 24, 1998

Related U.S. Application Data

[63] Continuation-in-part of application No. 08/618,113, Mar. 19, 1996, Pat. No. 5,785,094.

[30] Foreign Application Priority Data

| | | | |
|---|---|---|---|
| Mar. 23, 1995 | [JP] | Japan | 7-64345 |
| Jun. 2, 1995 | [JP] | Japan | 7-136887 |
| Jun. 27, 1995 | [JP] | Japan | 7-161106 |
| Mar. 13, 1996 | [JP] | Japan | 8-56493 |

[51] Int. Cl.[7] ..... B29D 28/00

[52] U.S. Cl. ..... 264/103; 139/384 R; 139/389; 139/420 A

[58] Field of Search ..... 264/103; 139/384 R, 139/389, 420 A

[56] References Cited

U.S. PATENT DOCUMENTS

| | | |
|---|---|---|
| 3,575,776 | 4/1971 | MacIntyre et al. . |
| 4,732,179 | 3/1988 | Takegawa . |
| 5,080,142 | 1/1992 | Calamito et al. . |
| 5,327,621 | 7/1994 | Yasui et al. . |
| 5,451,448 | 9/1995 | Sawko et al. . |
| 5,501,891 | 3/1996 | Saika et al. . |

FOREIGN PATENT DOCUMENTS

| | | |
|---|---|---|
| 0536937 | 4/1993 | European Pat. Off. . |
| 0685582 | 12/1995 | European Pat. Off. . |
| 3220709 | 12/1983 | Germany . |
| 7-34945 | 8/1995 | Japan . |
| 8-26496 | 3/1996 | Japan . |
| 853697 | 11/1960 | United Kingdom . |
| WO93/05219 | 3/1993 | WIPO . |

*Primary Examiner*—Christopher Raimund
*Attorney, Agent, or Firm*—Jordan and Hamburg LLP

[57] ABSTRACT

A three-dimensional woven fabric structure is integrally woven by a multi-ply weave having three or more plies, and includes a form defining a plurality of bag portions extending parallel with one another, and arranged in a plurality of rows. The bag portions in each row are defined by two woven fabric plies, the intersection of which along a crossing locus creates a bound portion between adjacent bag portions. Cylindrical bag portions in adjacent rows have a woven fabric ply in common and are interconnected at staggered positions. The fabric structure is creased at midpoints between bound portions whereby the bag portions are set to retain a hollow three-dimensional form, but may be folded flat into a juxtaposed state by application of pressure. A method is described for manufacturing the fabric structure wherein, during a weaving operation, the bag portions are interconnected in rows, and auxiliary yarns are inserted at opposite ends in a woven width direction and/or at required intervals therealong, without being woven into the fabric plies. The bag portions may then be set into juxtaposed position by a tightening of the auxiliary yarns, wherein a creasing treatment or heat setting is performed.

10 Claims, 17 Drawing Sheets

FIG. 4(A)
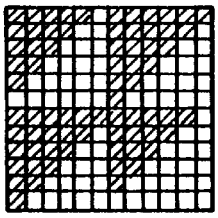
FIG. 4(B)
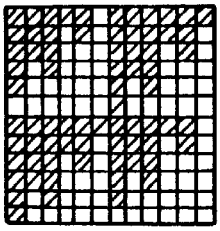
FIG. 4(C)
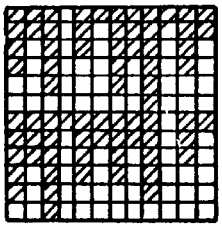
FIG. 4(D)
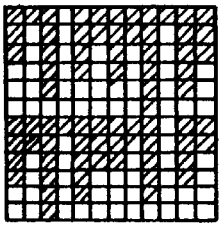
FIG. 4(E)
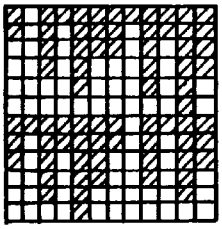
FIG. 4(F)
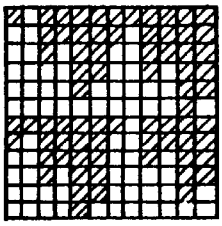
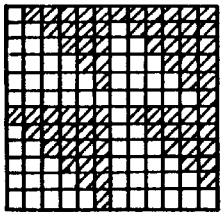
FIG. 4(G)
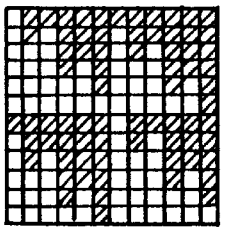
FIG. 4(H)
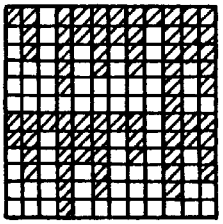
FIG. 4(I)
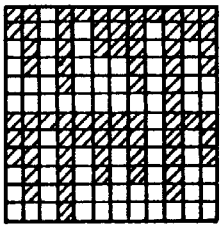
FIG. 4(J)
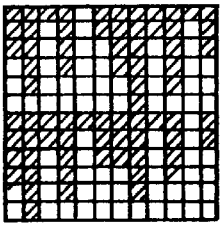
FIG. 4(K)
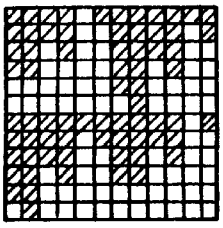
FIG. 4(L)

THREE-DIMENSIONAL WOVEN FABRIC STRUCTURAL MATERIAL AND METHOD OF PRODUCING SAME

This is a continuation-in-part, of application Ser. No. 08/618,113, filed Mar. 19, 1996, now U.S. Pat. No. 5,785,094.

TECHNICAL FIELD

The present invention relates to a structural material in the form of a three-dimensional woven fabric having hollow three-dimensional cylindrical bag portions, particularly to a three-dimensional woven fabric structural material, which can be widely used in various fields as interior decoration materials and composite structural materials for vehicles and houses, such as heat insulating materials, noise insulating materials, and reinforcing core materials, expansible structural materials for curtains and blinds, and tents and agricultural protectors and other industrial materials.

BACKGROUND OF THE INVENTION

Prior Art

Textile materials such as woven fabrics utilized in various uses are, generally, simply in sheet form. Therefore, in order to use them for structural materials of three-dimensional construction, sheet-like fabrics have to be interconnected as by sewing or have to be stacked; thus, there has been the problem of maintaining the strength in the joined portions. Even if they are stacked, the resulting stack is lacking in the cushioning property and presents a problem about the heat insulating property. For example, when it is used as a tent or the like, to impart the heat insulating property thereto it has been necessary to laminate thereto a sheet having a heat insulating property.

As for a textile material having a substantial thickness, there is known a double fabric comprising two sheets of raw material, face and back, and connecting portions which connect them by means of double knit or double weave. However, this double fabric, through having a more or less increased thickness, does not have cell-like hollow portions, poor in three-dimensional characteristics, such as heat and noise insulating properties and lightweight feature, there have been problems when it is used in the state in which it is filled with one of various materials.

A so-called honeycomb type blind is known which comprises oblong cylindrical portions of hexagonal or rhombic cross section interconnected in parallel for expansion and contraction like an accordion. However, conventional blinds using sheets such as nonwoven fabrics and paper require a complicated manufacturing process and lack toughness, presenting problems about durability.

Accordingly, it has been contemplated to integrally form a honeycomb type curtain or blind by binding two woven fabrics by two-ply weave at given intervals in the weaving direction to continuously form a number of long parallel cylindrical bag portions through the bound portions in the two woven fabric plies, said bag portions extending in the woven width direction.

In the case of such curtain or blind using two-ply weave, ink order to impart expansibility thereto it is necessary to expand the cylindrical bag portions in the face and back direction, impart creases to the rhombic or hexagonal cross section and then heat-set the same. This creasing treatment requires special bar-like molds, which have to be inserted in the individual cylindrical bag portions, an operation which is very troublesome. From a practical point of view, it is desirable to make it possible to effect this creasing treatment mechanically with ease.

Further, in the case of said curtain or blind by two-ply weave, since the cylindrical bag portions are intermittent through the linear bound portions, lacking in a voluminous feel, the light shielding and heat insulating properties being unsatisfactory

SUMMARY OF THE INVENTION

The present invention is intended to solve the above problems. A three-dimensional woven fabric structural material according to the invention of claimed 1 is a three-dimensional woven fabric structural material having a number of cylindrical bag portions which extend in parallel in one of the longitudinal and transverse directions and which are interconnected in a plurality of rows extending in the other direction, said three-dimensional woven fabric structural material being characterized in that it is integrally woven by a multi-ply weave having three or more plies, the cylindrical bag portions in each row being constructed in a bag form by at least two woven fabric plies and connected together in said other direction through bound portions in one of the two woven fabric plies, the cylindrical bag portions in adjacent rows being formed such that they have the woven fabric ply between the two rows in common and are interconnected at staggered positions, a creasing treatment being applied to the bound portions of the cylindrical bag portions in the woven fabric plies and/or to the middle position between the bound portions, whereby the cylindrical bag portions are set to assume a hollow three-dimensional form.

According to this three-dimensional woven fabric structural material, the cylindrical bag portions in each row are somewhat flattened in the weaving direction and set in a hollow three-dimensional form, whereby it has a predetermined thickness as a whole in the direction of the width and is light in weight and has sufficient cushioning property and compressive strength.

Particularly, it is formed by a multi-ply weave having three or more plies, the cylindrical bag portions being formed in a plurality of rows, the cylindrical bag portions in adjacent rows as disposed at staggered positions; thus, as a whole it is arranged in a honeycomb configuration. As a result, it has a considerably great thickness, as a whole, has a voluminous feel, is light in weight, and satisfactorily retains the cushioning property in the direction of the thickness and compressive strength.

Since the three-dimensional woven fabric structural material according to the present invention comprises an integrally woven fabric, there is no danger of the individual cylindrical bag portions being separated; it retains the configurationally stabilized form and even if it is subjected to repetitive expansion and contraction or comes in contact with something else, it will not be easily torn or scratched; it is superior in durability.

Therefore, the three-dimensional woven fabric structural material can be suitably used as a heat insulating material or a noise insulating material or cushioning material for mats by utilizing its heat and noise insulating properties and elasticity owing to its possession of thickness and space. Further, since the creased portions on the face and back sides are present in the same plane, the material can be easily used in combination with other sheet materials.

In an embodiment in accordance with the invention, said three-dimensional woven fabric structural material is characterized in that the cylindrical bag portions are formed such that they are foldable flat into the juxtaposed state and expansible in the direction in which the cylindrical bag portions are interconnected in a plurality of rows. This three-dimensional woven fabric structural material can be suitably used as an expansible structural material for bellows-like partitions, curtains, blinds and the like.

For example, since this three-dimensional woven fabric structural material is foldable and expansible through the deformation of the plurality of rows of cylindrical bag portions, it may be attached to a head box as in a conventional honeycomb type blind to provide a blind which can be expanded or folded upward. Furthermore, in the expanded state, the cylindrical bag portions are continuous in the state in which they are bulged into a vertically elongated hollow three-dimensional form of substantially rhombic sectional shape, so that there are no bound portions are present as independent. As a whole, the material is solid and has a voluminous feel, looks attractive and provides uniform light shielding.

In another embodiment, said three-dimensional woven fabric structural material is characterized in that auxiliary yarns extending through the cylindrical bag portions, in the direction in which the cylindrical bag portion are interconnected in a plurality of rows, without being woven into the woven fabric plies are inserted at the opposite ends of the cylindrical bag portions in the longitudinal direction and/or at required intervals in the same direction, said auxiliary yarns being for tightening purposes or expansion preventing purposes during folding into the juxtaposed state.

With this arrangement, in the case where the auxiliary yarns are for tightening purposes during folding into the juxtaposed position, the expansion operation by folding the cylindrical bag portions into the juxtaposed state during use as a curtain or blind can be easily effected. Further, when the auxiliary yarns are for expansion preventing purposes for preventing the cylindrical bag portions from expanding beyond a given limit, the cylindrical bag portions can be prevented by the auxiliary yarns from being deformed into an elongated rhombic form such that the higher the cylindrical bag portions are located, the greater the deformation. As a whole, the degree of expansion of the cylindrical bag portion can be maintained constant, the product looking attractive and from this state it can be easily folded flat.

In a further embodiment, said three-dimensional woven fabric structural material is characterized in that it bulges outward without having a creasing treatment applied to the middle position between the bound portions of the cylindrical bag portions in the woven fabric plies of the cylindrical bag portions appeared on the face and back sides of the three-dimensional woven fabric structural material.

With this arrangement, the material exhibits a round soft external appearance as a whole with the cylindrical bag portions bulging outward at given intervals. The material looks attractive and can be suitably used for curtains, blinds, tents and agricultural protective materials.

In yet another embodiment, said three-dimensional woven fabric structural material is characterized in that a resin treatment is applied to each woven fabric ply, whereby the cylindrical bag portions are fixed so as to retain the hollow three-dimensional form, said material being in the panel form.

In this case, partly because the cylindrical bag portions are constructed in a honeycomb manner, the material is superior in the compressive strength in the direction of thickness and the cylindrical bag portions properly retain their shape; it is suitably used as various three-dimensional lightweight strong structural materials such as building materials. Further, it can be utilized as a reinforcing core material for plastic products.

An addition embodiment in accordance with invention relates to a method of producing a blind, characterized in that a multi-ply weave having three or more plies is employed, whereby the positions of the woven fabric plies are successively shifted in the weaving direction at predetermined intervals and obliquely moved to the opposite side between the face and back sides, whereby two of the plies are crossed to form bound portions, and cylindrical bag portions constructed in bag form by at least two woven fabric plies are interconnected in a plurality of rows through said bound portions in the weaving direction, the cylindrical bag portions in adjacent rows having the woven fabric ply disposed therebetween in common and formed at staggered positions, and thereafter, with the cylindrical bag portions in each row being in the state in which they are folded into the juxtaposed state in the weaving direction, a creasing treatment is applied to the middle position between the bound portions in the woven fabric plies on the face and back sides or setting is effected to allow the cylindrical bag portions to retain the hollow three-dimensional form.

With this method, it is possible to easily produce an integrated three-dimensional woven fabric structural material in a honeycomb form made by said three woven fabric plies, particularly a three-dimensional woven fabric structural material which is superior in light shielding, heat and noise insulating properties, and elasticity and which can be used for various applications.

In yet another embodiment, said method of producing three-dimensional woven fabric structural materials is characterized in that auxiliary yarns extending through the cylindrical bag portions, in the direction in which the cylindrical bag portion are interconnected in a plurality of rows, without being woven into the woven fabric plies are inserted at the opposite ends in the woven width direction and/or at required intervals in the woven width direction, said auxiliary yarns being tightened after weaving, thereby folding the cylindrical bag portions into the juxtaposed state in the weaving direction, and a crease treatment is applied to the middle position between the bound portions in the woven fabric plies in the rows on the face and back sides. With this method, since the tightening of the auxiliary yarns results in the bound portions overlapping each other in the same position, pressing the cylindrical portions in this state in the overlapping direction results in creasing at the central position between the bound portions of the woven fabric plies in the cylindrical bag portions; thus, the creasing treatment can be easily performed and the production of the material is further facilitated. Furthermore, the auxiliary yarns may be left to serve as tightening yarns or expansion-preventing yarns according to need.

Another embodiment is directed to a method of producing three-dimensional woven fabric structural materials which is characterized in that weaving is effected such that at least in portions of the woven fabric plies on the cylindrical bag portions on the face and back sides where a creasing treatment is applied, thin yarns or hard monofilament yarns serving as weft yarns are inserted or said portions are left vacant of weft yarns.

With this method, the creasing treatment can be more easily performed and the folding into the juxtaposition for creasing can be omitted, facilitating the configurational retention and expansion and contraction operation during use.

In said method of producing three-dimensional woven fabric structural materials, weaving can be effected such that in required portions of the woven fabric plies on the face and back sides, a yarn or yarns to be used as weft yarns having a greater heat shrinkage factor than the other weft yarns are inserted, said yarns having a greater heat shrinkage factor being shrunk by heat treatment after weaving.

In the case of this type of weaving, the shrinkage of the weft yarns can impart a shrinkage effect to the woven fabric plies, thereby providing a three-dimensional woven fabric structural material which exhibits undulations peculiar to crepe fabric and which is superior in design effect. This three-dimensional woven fabric structural material can be suitably used for curtains and blinds.

A still further embodiment is a method of producing three-dimensional woven fabric structural materials, wherein such material is integrally woven in double weave such that a number of cylindrical bag portions extending in parallel in one of the longitudinal and transverse directions are interconnected in the other direction through bound portions of the two woven fabric plies, said method being characterized in that weaving is effected such that the two woven fabric plies are bound at given intervals in the weaving direction, the cylindrical bag portions defined by the two woven fabric plies are interconnected in the weaving direction through the bound portions of the two woven fabric plies, and auxiliary yarns extending through the cylindrical bag portions in the weaving direction without being woven into the woven fabric plies are inserted at the opposite ends in the woven width direction and/or at required intervals in the woven width direction, said auxiliary yarns being tightened after weaving, thereby folding the cylindrical bag portions flat into the juxtaposed state in the weaving direction, and either a creasing treatment is applied to the middle position between the bound portions in the woven fabric plies in the cylindrical bag portions or heat setting is effected without such creasing treatment.

With this method, it is possible to easily produce a three-dimensional woven fabric structural material having a number of cylindrical bag portions interconnected through bound portions in the two woven fabric plies, and a three-dimensional woven fabric structural material which can be suitably used as honeycomb type curtains and blinds and as noise insulating materials and intermediate materials. Particularly, the tightening of the auxiliary yarns subsequent to the weaving causes the cylindrical bag portions to be folded flat into the juxtaposed state, with the bound portions overlapping each other in the same position; thus, pressing the cylindrical bag portions in this state in the overlapping direction results in creasing at the middle position between the bound portions in the woven fabric plies in the cylindrical bag portions, thus, the creasing treatment is facilitated. Furthermore, the auxiliary yarns may be utilized as tightening yarns or expansion-preventing yarns.

In said method, weaving can be effected such that at portions of the woven fabric plies in the cylindrical bag portions on the face and back sides, thin yarns or hard monofilament yarns serving as weft yarns are inserted or said portions are left vacant of weft yarns. Thereby, the creasing treatment can be performed more easily and it becomes possible to omit such creasing treatment. Further, the configurational retention and expansion and contraction operation during use can be facilitated.

In another embodiment, said method is characterized in that a resin treatment is applied to each woven fabric ply to harden the latter in panel form, so that the cylindrical bag portions retain the hollow three-dimensional form. Thus, the material can be used for various reinforcing core materials and intermediate materials.

Still another embodiment provides a method of producing three-dimensional woven fabric structural materials, wherein such material is integrally woven by double weave such that a number of cylindrical bag portions extending in parallel in one of the longitudinal and transverse directions are interconnected in the other direction through bound portions of the two woven fabric plies, said method being characterized in that weaving is effected such that the cylindrical bag portions defined by the two woven fabric plies are interconnected in the weaving direction through the bound portions of the two woven fabric plies, and in required portions of the woven fabric plies on the face and back sides, a yarn or yarns to be used as yarns extending longitudinally of the cylindrical bag portions and having a greater heat shrinkage factor than the other yarns are inserted, and setting is effected by heat treatment after weaving, whereby the cylindrical bag portions assume a hollow three-dimensional form and said yarns having a greater heat shrinkage factor are shrunk.

With this method, the shrinkage of the yarns having a greater shrinkage factor imparts a shrinkage effect to the woven fabric plies, providing a three-dimensional woven fabric structural material which exhibits undulations peculiar to crepe fabric and which is superior in design effect and can be suitably used for curtains and blinds.

BRIEF DESCRIPTION OF THE DRAWINGS

FIGS. 4A–4L are weave charts for said three-dimensional woven fabric structural material;

DESCRIPTION OF PREFERRED EMBODIMENTS

Figure 1A:
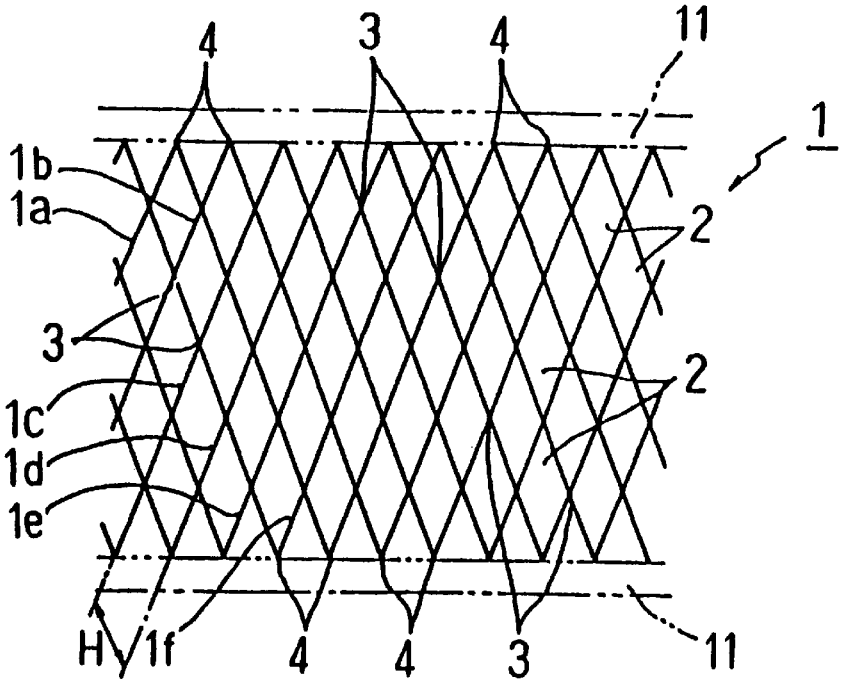
FIG. 1A and FIG. 1B are a schematic fragmentary sectional view and a schematic perspective view respectively, showing a three-dimensional woven fabric structural material according to a first embodiment of the invention.
Figure 1B:
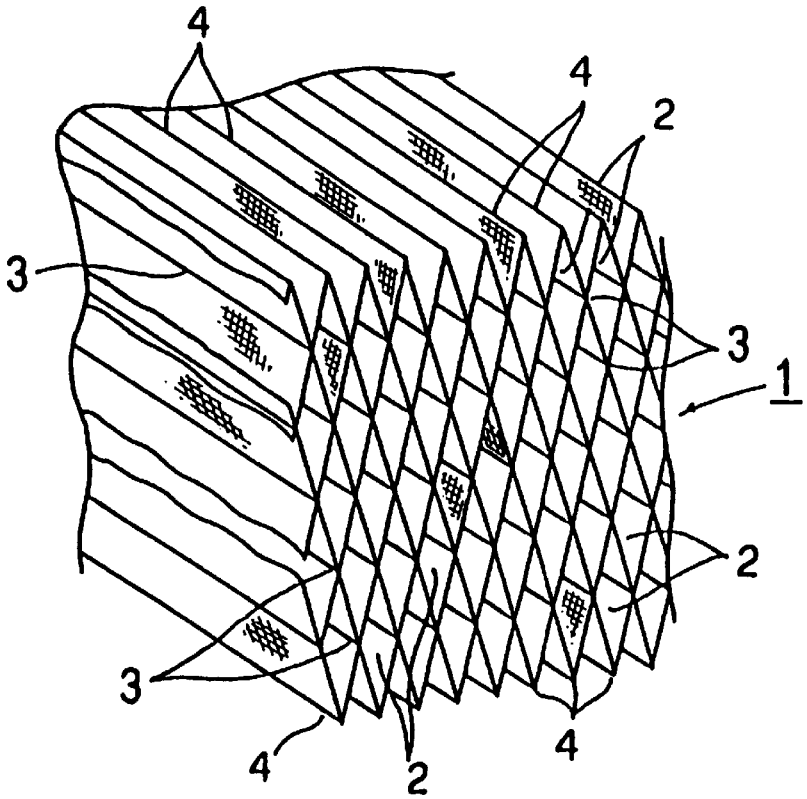
Figure 2:
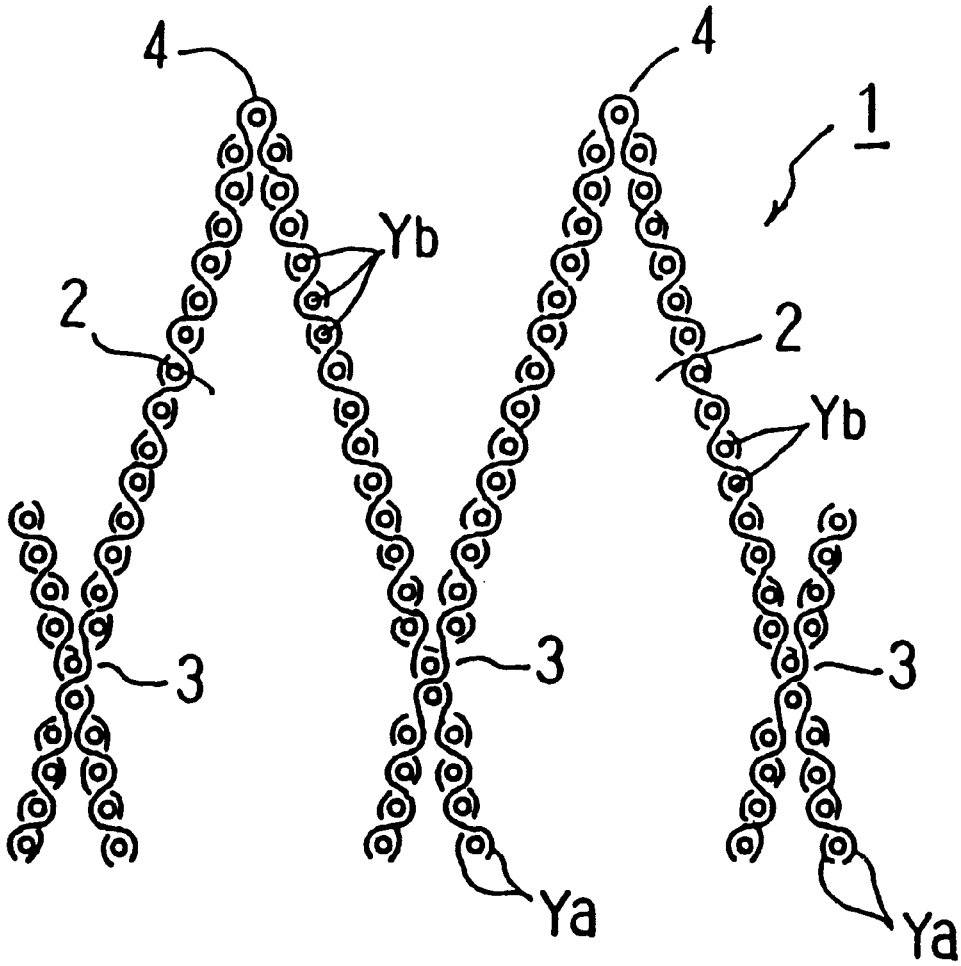
FIG. 2 is an enlarged sectional view of a portion of the same.

FIG. 1A and FIG. 1B are a schematic fragmentary sectional view and a schematic perspective view respectively, showing a three-dimensional woven fabric structural material according to a first embodiment of the invention, whereas FIG. 2 is an enlarged sectional view of a portion of the same.

In the figure, the numeral 1 denotes a three-dimensional woven fabric structural material according to claim 1, having the following arrangement.

The three-dimensional woven fabric structural material 1 is integrally woven by a multi-ply weave having three or more plies, wherein a number of cylindrical bag portions of substantially rhombic sectional shape extending in parallel in one of the longitudinal and transverse directions (which, in FIG. 1A, the direction which is perpendicular to the paper) are continuously formed in a plurality of rows extending in the other direction (which, in FIG. 1A, the horizontal direction).

Overall, it is composed of six woven fabric plies la, 1*b*, 1*c*, 1*d*, 1*e*, 1*f*, whose positions are successively shifted in the weaving direction at predetermined intervals and obliquely moved to the opposite side between the face and back sides, whereby two of the plies are crossed to form bound portions 3 (where the two plies are immovably bound together). Thus, cylindrical bag portions 2 constructed in bag form by at least two woven fabric plies to extend in the woven width direction (which, in FIG. 1A, is perpendicular to the paper) are interconnected through the bound portions 3 and in a plurality of rows in the weaving direction (which, in FIG. 1, is the horizontal direction). The cylindrical bag portions 2 in adjacent rows have the woven fabric ply disposed therebetween in common and are interconnected at staggered positions.

And a creasing treatment is applied to the central position between the bound portions 3 in the woven fabric plies on the face and back sides and to the bound portions 3, so that the cylindrical bag portions 2, as shown, e.g., in FIG. 1, are set to retain a hollow three-dimensional form somewhat flattened in the weaving direction, forming a honeycomb configuration as a whole with the cylindrical bag portions 2 in adjacent rows disposed at staggered positions. The numeral 4 denotes creased portions between the bound portions, on the face and back sides. In FIG. 2, Ya denotes warp yarns and Yb denotes weft yarns.

Figure 3:
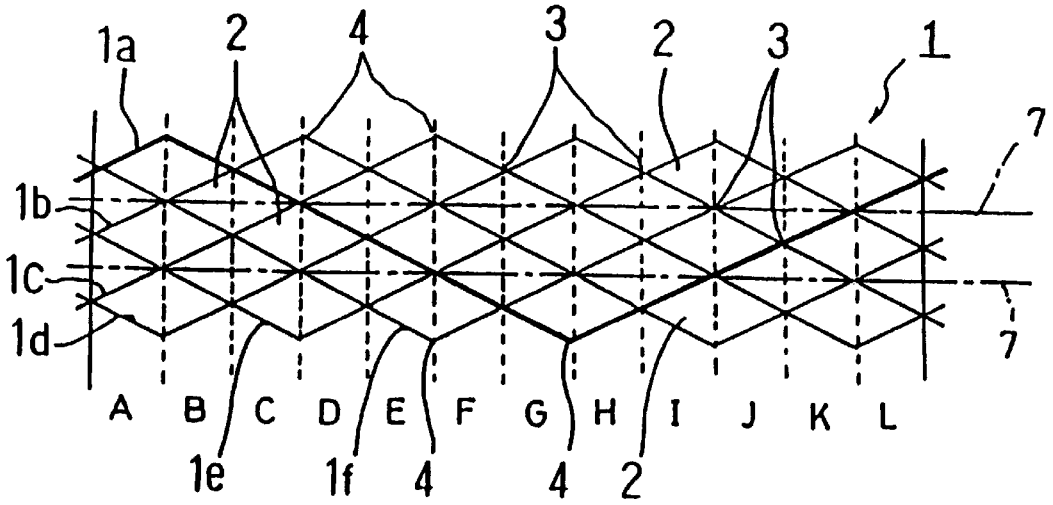
FIG. 3 is a schematic structural view showing said three-dimensional woven fabric structural material during weaving.
Figure 5:
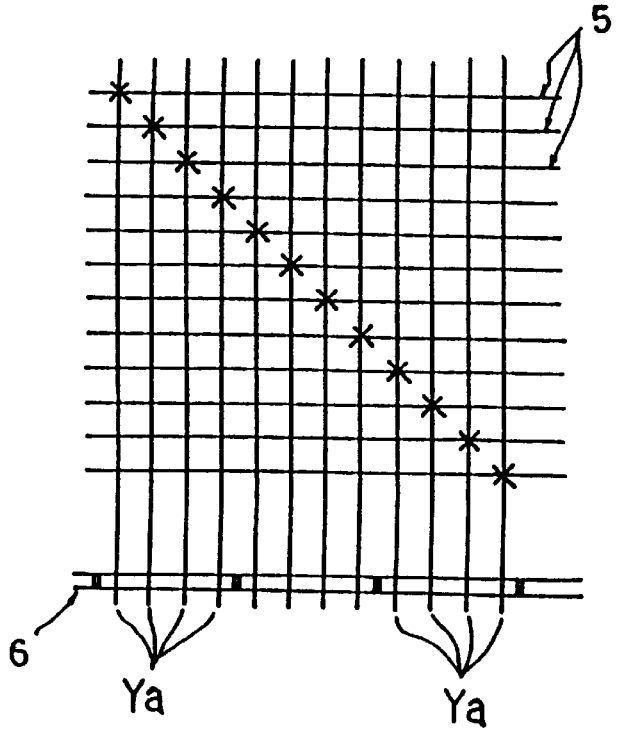
FIG. 5 is a lifting plan for said three-dimensional woven fabric structural material.

This three-dimensional woven fabric structural material 1 is woven such that the weaving ranges A through L shown, e.g., in the structural view in FIG. 3 are taken as 1 repeat to follow the weave charts (A) through (L) shown in FIGS. 4A–4L and the lifting plaza shown in FIG. 5, respectively corresponding thereto. FIG. 3 schematically shows 6 woven fabric plies la through if with continuous warp yarns (weft yarns being omitted). In the lifting plan shown in FIGS. 4A–4L, whether a warp yarn is up or down with respect to a weft yarn is shown (shaded region indicating up-position) in the individual structural ranges A through L. In FIG. 5, the horizontal lines indicate healds 5 and the vertical lines indicate warp yarns Ya, and the intersections marked X between the horizontal and vertical lines indicate places where warp yarns Ya are inserted in the healds.

In this weaving operation, warp yarns Ya are inserted in 12 healds 5 in straight draw, as shown in FIG. 5, and four yarns in a set are inserted in a single space between adjacent dents in a reed and weaving is effected as shown in FIG. 3 in accordance with the weave shown in FIGS. 4A–4L (each woven fabric ply being of plain weave). In FIG. 3, the 6 woven fabric plies 1*a* through 1*f* are obliquely moved to the opposite side between the face and back sides at predetermined intervals in the weaving direction, so that woven fabric plies 1*a* through 1*f* successively appear in the face and back sides, said woven fabric plies 1*a* through 1*f* being crossed two by two to form bound portions, thus constructing cylindrical bag portions 2 delimited by these woven fabric plies 1*a* through 1*f*. As a result of such weaving, the cylindrical bag portions 2 are interconnected in a plurality of rows through the bound portions 3 in the weaving direction, and the cylindrical bag portions 2 in adjacent rows are formed at staggered positions, having the woven fabric ply between the two rows in common.

Thereafter, a creasing treatment is applied to the middle of the cylindrical portions 2 on the face and back sides as viewed in the weaving direction, i.e., to the middle position between the bound portions 3 to allow the woven fabric ply in said portions to form an outwardly directed ridge. Further, concurrently therewith, a setting treatment is applied to the bound portions 3, so that the woven fabric plies delimiting the cylindrical bag portions 2 through said portions are outwardly developed, followed, if necessary, by a heat treatment and/or resin treatment. In this case, if the woven fabric plies 1*a* through 1*f* are woven with different weaves for the weaving ranges A through L, this makes it easier to apply a creasing treatment.

Thereby, the cylindrical bag portions 2 are set such that they are somewhat flattened in a substantially rhombic sectional shape in the weaving direction, providing a three-dimensional woven fabric structural material 1 in the form shown in FIG. 1.

This three-dimensional woven fabric structural material 1 has a plurality of rows of cylindrical bag portions 2 disposed at staggered positions in honeycomb form, having a considerable thickness as a whole, and the cushion property and compression strength in the direction of the thickness are satisfactory and so are the heat insulating property and noise insulating property.

In addition, the degree of flatness of the cylindrical bag portions 2 in the weaving direction during setting can be optionally determined. However, it is to be noted that the more the bag portions 2 are flattened, the higher the density is and so are the cushion property and compression strength in the direction of the thickness. Therefore, it is preferable to flatten them in the weaving direction for use as a cushion material or intermediate material, while for use as a tent or agricultural sheet, it is preferable to flatten them in the direction of the thickness, not in the weaving direction.

Figure 6A:
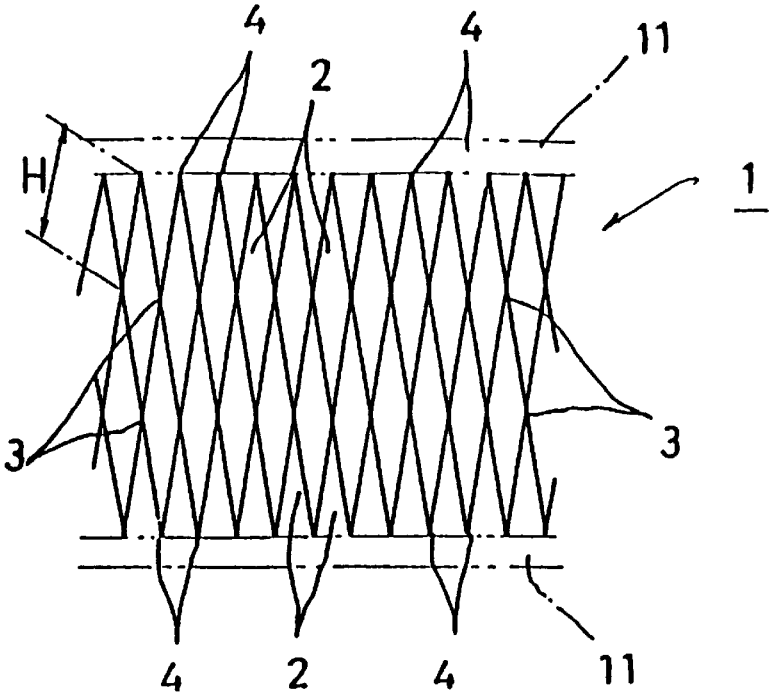
FIG. 6A and FIG. 6B are a schematic fragmentary sectional view and a schematic perspective view respectively, showing a three-dimensional woven fabric structural material according to another embodiment of the invention.
Figure 6B:
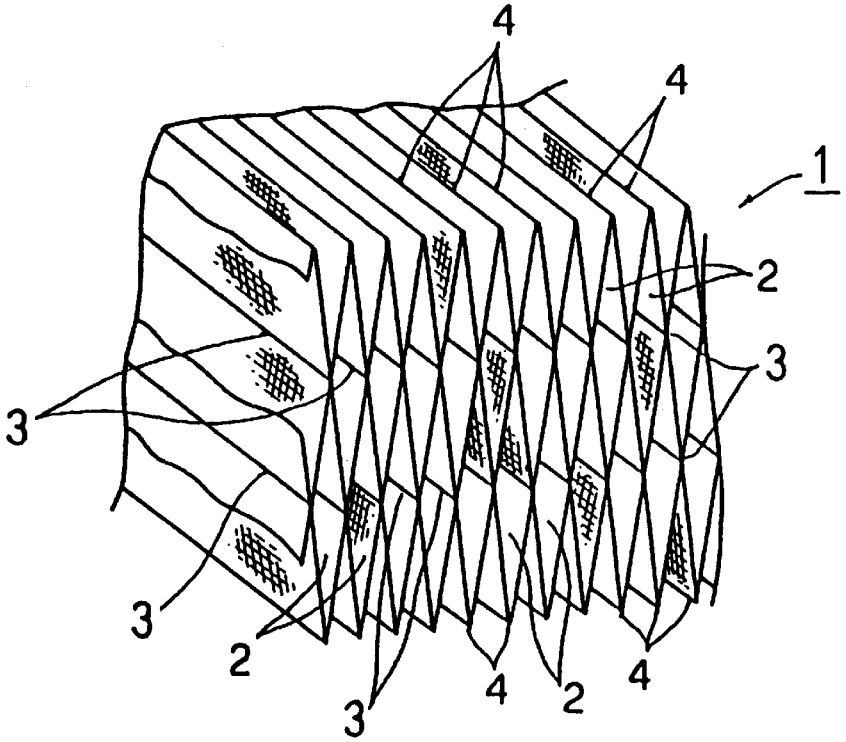

FIG. 6A and FIG. 6B show an embodiment of the three-dimensional woven fabric structural material 1 integrally woven with three plies.

Figure 7:
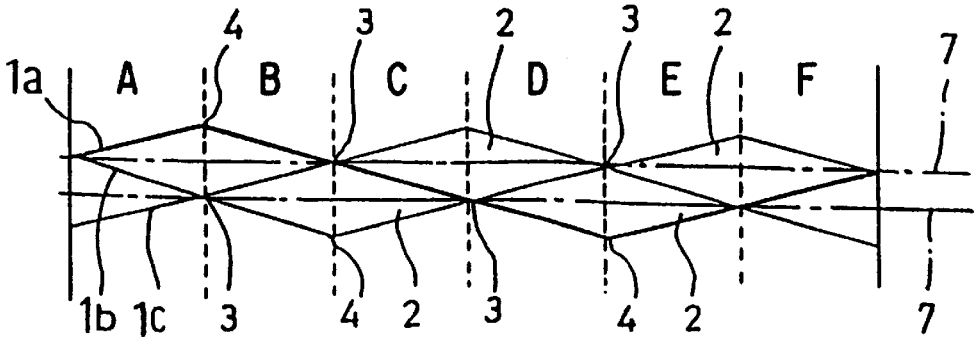
FIG. 7 is a schematic structural view of said three-dimensional woven fabric structural material
Figures 8A, 8B, 8C:
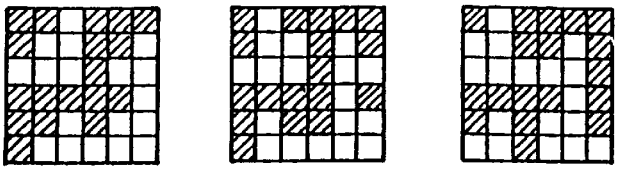
FIGS. 8A–8F are weave charts for said three-dimensional woven fabric structural material.
Figures 8D, 8E, 8F:
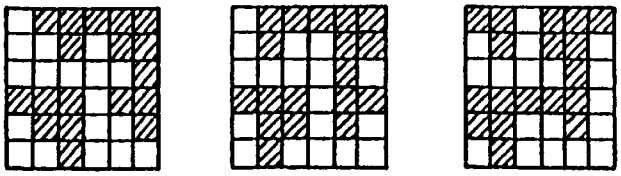
Figure 9:
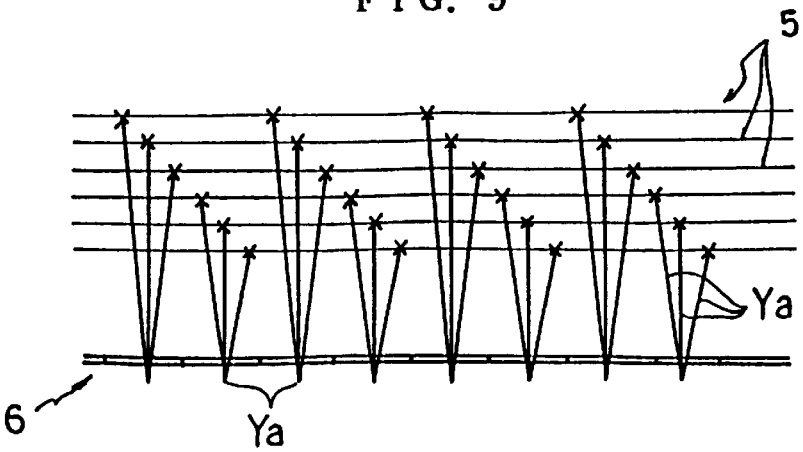
FIG. 9 is a lifting plan for said three-dimensional woven fabric structural material.

The three-dimensional woven fabric structural material 1 in this embodiment is woven such that the weaving ranges A through F shown in the structural view in FIG. 7 are taken as 1 repeat to follow the weave charts (A) through (F) shown in FIGS. 8A–8F and the lifting plan shown in FIG. 9, respectively corresponding thereto. FIG. 7 schematically shows three woven fabric plies 1*a,* 1*b,* 1*c* having continuous warp yarns with weft yarns omitted, and FIG. 8 shows unit weaves for the structural ranges A through F. In FIG. 9, the horizontal lines indicate healds 5 and the vertical lines indicate warp yarns Ya, and the intersections marked X between the horizontal and vertical lines indicate places where warp yarns are inserted in the healds.

In this weaving operation, warp yarns are inserted in six healds 5 in straight draw and three yarns in a set are inserted in a space between adjacent dents in a reed, and in accordance with the weave shown in FIG. 8 (the face, middle, back being of plain weave) three woven fabric plies 1*a* through 1*c* are obliquely moved to the opposite side between the face and back sides at predetermined intervals in the weaving direction to allow the woven fabric plies 1*a* through 1*c* to alternately appear on the front and back sides while allowing any two plies to cross each other to form bound portions. Thereby, the cylindrical bag portions 2 on the face and back sides delimited by these woven fabric plies 1*a* through 1*c* are interconnected in large numbers in a plurality of rows in the weaving direction through bound portions 3, and are formed in a staggered manner, the woven fabric ply between two rows used in common. That is, the cylindrical bag portions 2 between two rows are staggered on the face and back sides to be positioned in zigzag in the weaving direction.

Thereafter, as in the above embodiment, a creasing treatment is applied to the middle of the cylindrical bag portions 2 on the face and back sides, i.e., to the middle position between the bound portions 3 in the weaving direction, and concurrently therewith, a setting treatment is applied to the bound portions 3 to outwardly develop the woven fabric plies, followed, if necessary, by a heat treatment and/or resin treatment. In this case also, if the weaving is effected to form different weaves for the weaving ranges A through F, this makes it easier to apply a creasing treatment.

Thereby, a three-dimensional woven fabric structural material 1 in the form shown in FIG. 6 is obtained, wherein the cylindrical bag portions 2 on the face and back sides present a hollow three-dimensional form of substantially rhombic sectional shape somewhat flattened in the weaving direction.

In this three-dimensional woven fabric structural material 1 also, the cylindrical bag portions 2 on the face and back sides are disposed in a staggered manner, having a considerable thickness as a whole, so that the cushion property and compression strength in the direction of the thickness are satisfactorily retained and so are the heat resistance and noise insulating property.

In addition, in this embodiment using three-ply weave, besides the aforesaid weaving manner, the face and back woven fabric plies and the intermediate woven fabric ply may be woven without crossing each other but by allowing the intermediate woven fabric ply to alternately cross the face and back woven fabric plies at predetermined intervals in the weaving direction, thereby forming cylindrical bag portions interconnected in zigzag, and the same creasing treatment as described above may be applied to these cylindrical bag portions.

The three-dimensional woven fabric structural material 1 of multi-ply weave comprising three or more plies is long-sized having a relatively large width (e.g., 2 m), so that it may be cut to desired sizes according to the purpose, application and location of use thereof; it may be used for various applications, for example, as cushion material, noise insulating material or reinforcing core material.

Particularly, since the face and back creased portions 4 of the three-dimensional woven fabric structural material 1 lie in the same plane in the direction in which the cylindrical bag portion are interconnected in a plurality of rows, sheet materials 11 having suitable degree of flexibility, such as knitted or woven fabrics or synthetic resin fabrics, may be placed on one of the face and back sides or on both sides as shown in dot-two-dash lines in FIG. 1 and bound as by sewing at the creased portions 4, enabling the structural material to be used as a composite structural material. The hollow spaces of the cylindrical bag portions 2 may be filled with a heat insulating material such as urethane foam to improve the heat insulating property. Rigid sheets may be added to form a composite structural material. These composite structural materials can be satisfactorily used as interior decoration materials, matting, or building materials.

In the aforesaid three-dimensional woven fabric structural material 1, the cylindrical bag portions 2 are constructed to be expansible and to be foldable into the juxtaposed state in the weaving direction; thus, by utilizing the flexibility, the structural material can be used as an expansible structure such as a partition, curtain or blind and as a tent material.

Figure 10A:
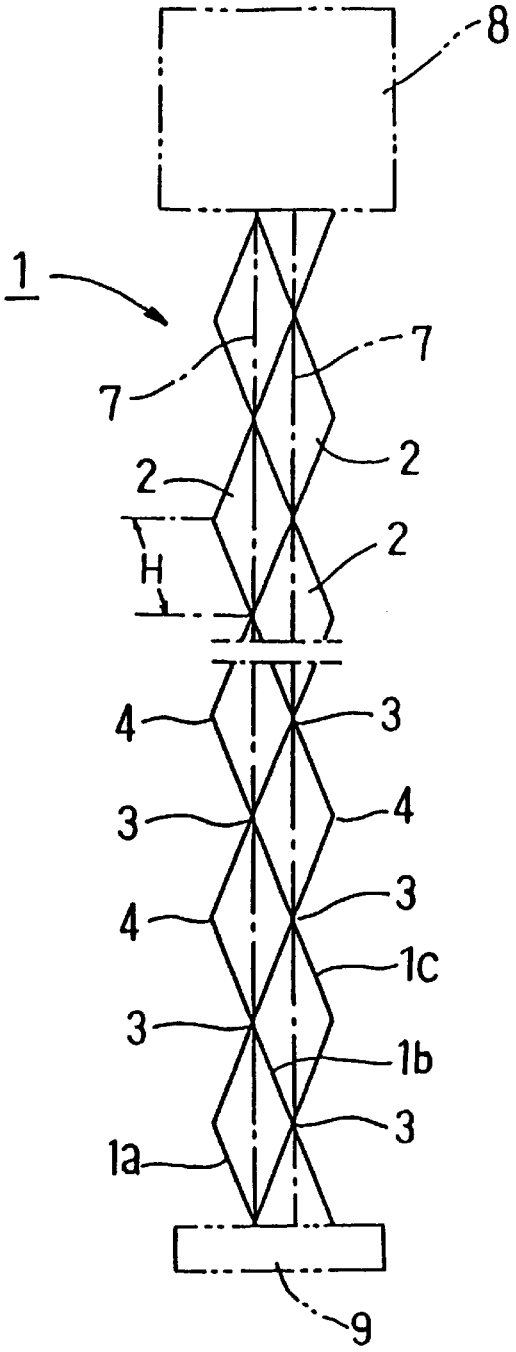
FIG. 10A and FIG. 10B are schematic fragmentary side views, in longitudinal section, showing an example of said three-dimensional woven fabric structural material being used as a blind which is shown in the stretched state (FIG. 10A) and in the contracted state (FIG. 10B)
Figure 10B:
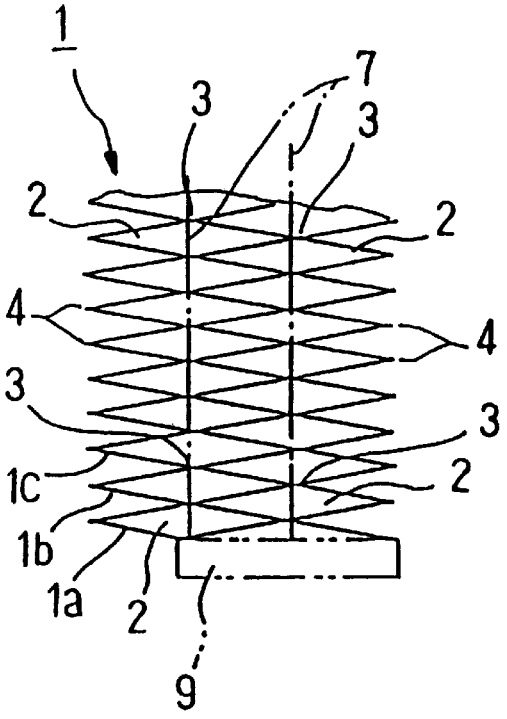

FIG. 10 shows an example of use as a blind, wherein in use, the three-dimensional woven fabric structural material 1 is attached to a head box 8. The attaching construction therefor and for a bottom rail 9 at the lower end, and the lifting means for raising and lowering may be the same as in a conventional honeycomb type blind.

In use, since the cylindrical bag portions 2 are interconnected in a plurality of rows bulged into a hollow three-dimensional form of substantially rhombic sectional shape, there are no bound portions 3 that are present as independent, so that the light shielding state becomes substantially uniform and the heat resistance is improved. Further, since it is a woven fabric, it will not be readily damaged even if expansion and contraction are repeated many times or even if it abuts against something else.

Figure 11:
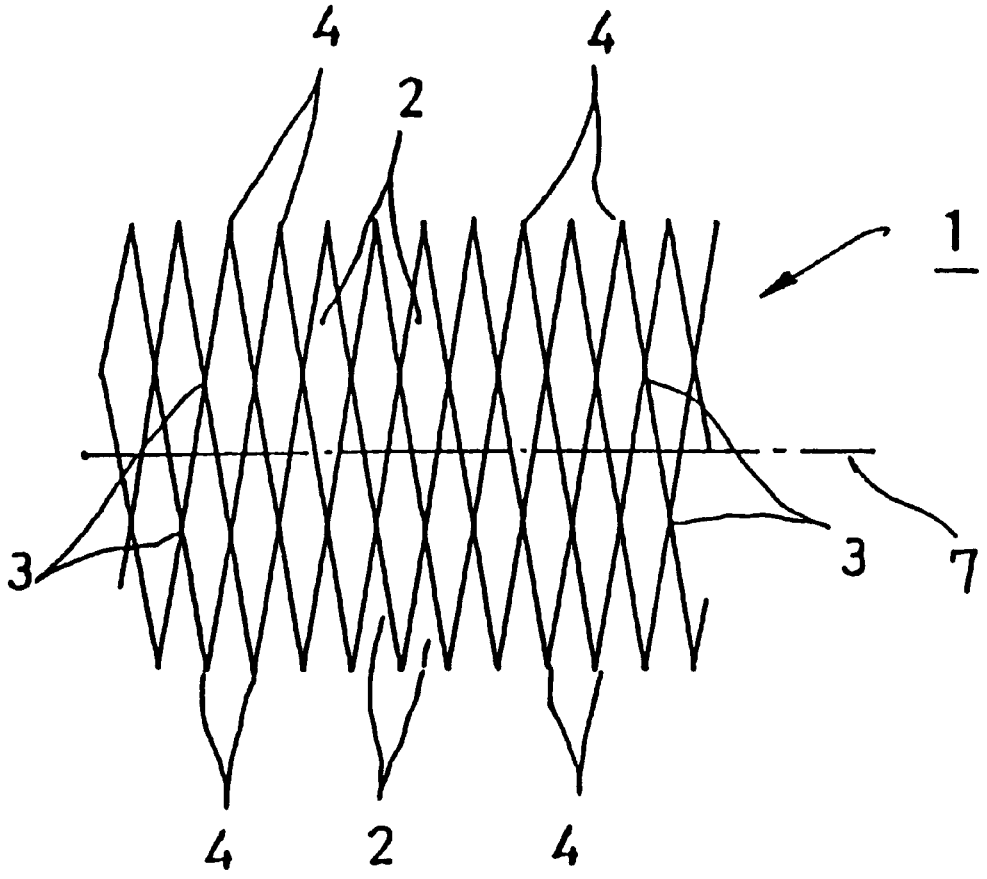
FIG. 11 is a schematic fragmentary sectional view showing an embodiment wherein an auxiliary yarn is inserted in a different manner.

In any of the embodiments having a multi-ply weave, weaving may be effected such that for example as shown in dash-dot lines in FIG. 3, 7 or 11, in any of the plurality of rows of cylindrical bag portions 2, auxiliary yarns 7 formed of high tensile strength fiber, such as KEVLAR (trademark), monofilament yarns or string-like yarns, may be incorporated in such a manner that they are not woven into the woven fabric ply but simply extend through the cylindrical bag portions 2 at the opposite ends in the woven width direction and/or at required intervals in the woven width direction.

The auxiliary yarns 7 may be passed through the cylindrical bag portions 2 either through the bound portions 3, as shown in FIGS. 3 and 7, or through the intermediate position in the woven fabric plies between the bound portions 3, as shown in FIG. 11. Alternatively, a plurality of yarns bundled together may be used as an auxiliary yarn 7.

After the weaving operation described above, when the auxiliary yarns 7 are tightened, the bound portions 3 in each row overlap at the same positions, so that the cylindrical bag portions 2 are folded flat into the juxtaposed state in the weaving direction; thus, they are pressed in the folding direction and heat-set, whereby creases can be simultaneously formed at the middle position between the bound portions 3 of the cylindrical bag portions 2. Therefore, without using a special mold, the creasing treatment can be efficiently performed.

The auxiliary yarns 7 are allowed to remain with a suitable length, whereby expansion or deformation of the cylindrical bag portions in the weaving direction can be prevented by the auxiliary yarns 7, so that they can be satisfactorily maintained in a substantially uniform hollow three-dimensional form. In the case where the three-dimensional structural material 1 is used as a blind, the auxiliary yarns 7 can be used for tightening purposes for folding into the juxtaposed state or for expansion preventing purposes, so that expansion and contraction for folding can be easily effected and in the expanded state, the cylindrical bag portions 2 can be satisfactorily held substantially uniformly expanded.

For example, as shown in FIG. 10A, in the state where the three-dimensional woven fabric structural material 1 attached to the head box 8 is expanded, the higher the cylindrical bag portions 2 are positioned, the more they tend to be longitudinally deformed under their own weight, but if auxiliary yarns 7 are inserted, they can prevent such deformation.

Instead of the auxiliary yarns 7 to be inserted by weaving, other auxiliary yarns, such as string-like yarns, may be likewise inserted after weaving operation, so as to provide tightening and shape retention functions.

Figure 12A:
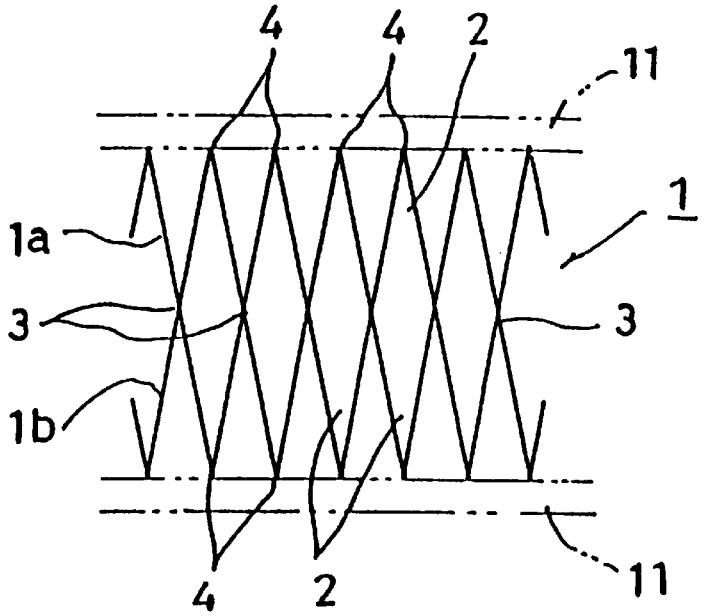
FIG. 12A and FIG. 12B are a schematic fragmentary sectional view and a schematic perspective view respectively, showing a three-dimensional woven fabric structural material produced by a production method based on two-ply weave according to the present invention.
Figure 12B:
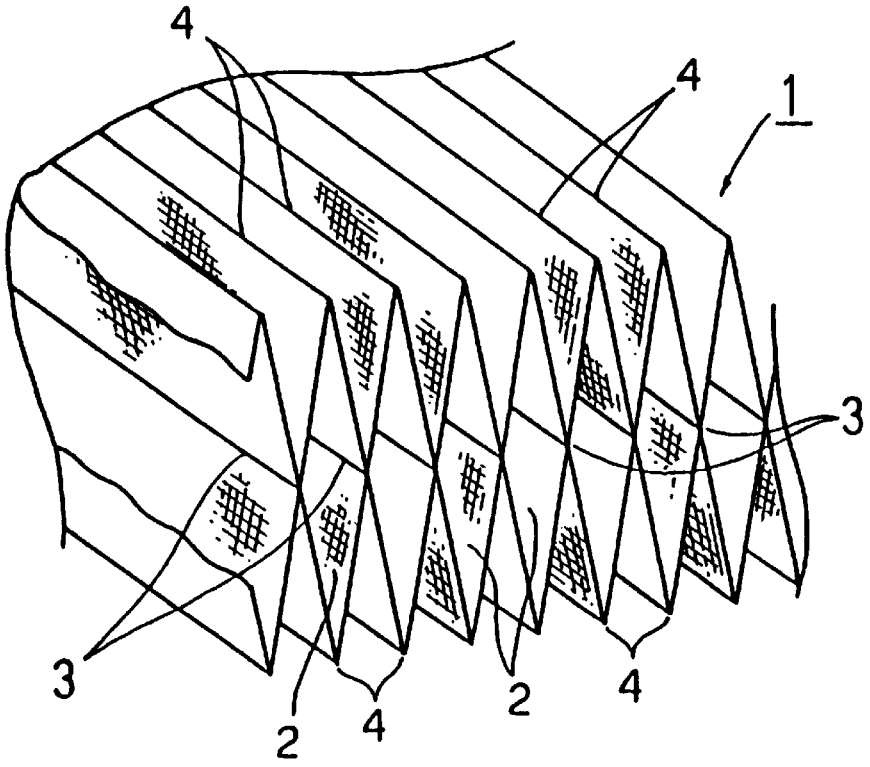

According to the method in which auxiliary yarns 7 extend through the cylindrical bag portions 2 without being woven into the woven fabric plies, a three-dimensional woven fabric structural material 1 constructed by double weave as shown in FIG. 12A and FIG. 12B can be easily produced.

Figure 13:
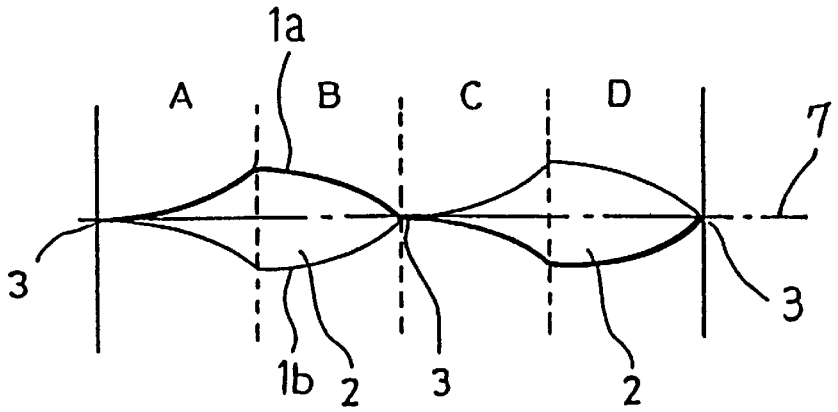
FIG. 13 is a schematic structural view showing how to embody said production method for producing three-dimensional woven fabric structural material.
Figures 14A, 14B, 14C, 14D:
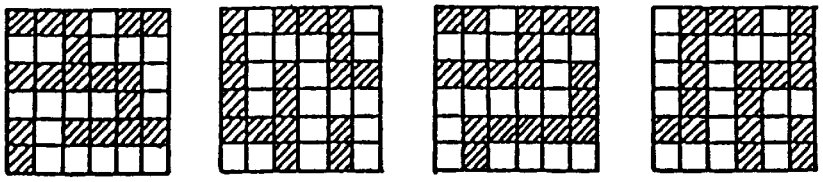
FIGS. 14A–14D are weave charts for a three-dimensional woven fabric structural material produced by said method.
Figure 15:
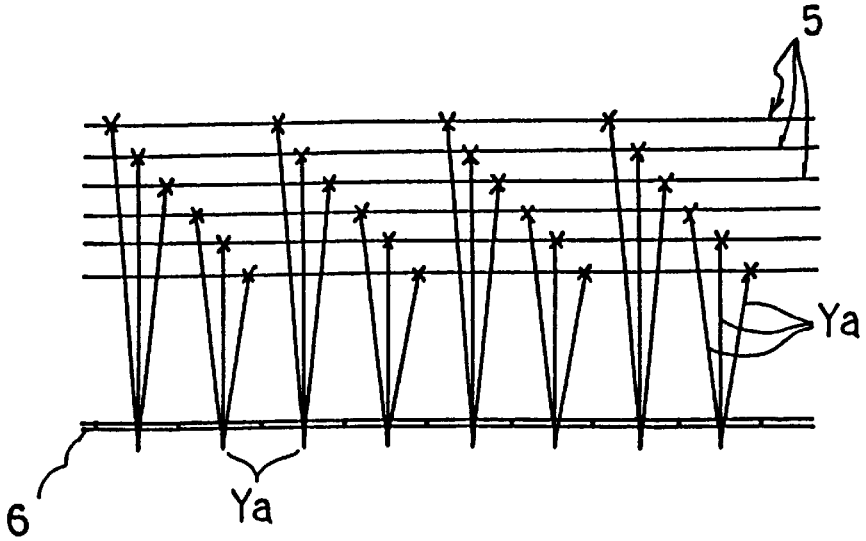
FIG. 15 is a lifting plan for weaving a three-dimensional woven fabric structural material by said method.

This three-dimensional woven fabric structural material 1 is woven such that the weaving ranges A through D shown in the structural view in FIG. 13 are taken as 1 repeat to follow the weave charts (A) through (D) shown in FIGS. 14A–14D and the lifting plan shown in FIG. 15, respectively corresponding thereto. FIG. 13 schematically shows two woven fabric plies 1*a,* 1*b,* and in FIG. 15, the horizontal lines indicate healds 5 and the vertical lines indicate warp yarns Ya, and the intersections marked X between the horizontal and vertical lines indicate places where warp yarns are inserted in the healds.

In weaving, as in the case of the aforesaid multi-ply weave, two woven fabric plies 1*a,* 1*b* are moved to the opposite side between the face and back sides at predetermined intervals in the weaving direction to cross each other to form bound portions, whereby the weaving ranges A through D are woven and the cylindrical bag portions 2 delimited by the two woven fabric plies 1*a*, 1*b* are continuously formed in the weaving direction through the bound portions 3. In this case, as shown in a dash-dot line in FIG. 13, auxiliary yarns 7 formed of high tensile strength fiber, or monofilament yarns or string-like yarns, may be incorporated in such a manner that they are not woven into the woven fabric plies but simply extend through the cylindrical bag portions 2 in the weaving direction at the opposite ends in the woven width direction and/or at required intervals in the woven width direction.

After the weaving operation, when the auxiliary yarns 7 are tightened, the bound portions 3 pile up at the same positions, so, that the cylindrical bag portions 2 are folded flat into the juxtaposed state in the weaving direction; thus, in this state they are pressed in the folding direction and heat-set, whereby creases can be simultaneously formed at the middle position between the bound portions 3 of the cylindrical bag portions 2, thus, the creasing treatment can be efficiently performed.

Thus, by effecting the setting such that the cylindrical bag portions 2 assume a hollow three-dimensional form of substantially rhombic sectional shape flattened in the weaving direction, a three-dimensional woven fabric structural material 1 shown in FIG. 12 can be easily obtained.

Figure 16A:
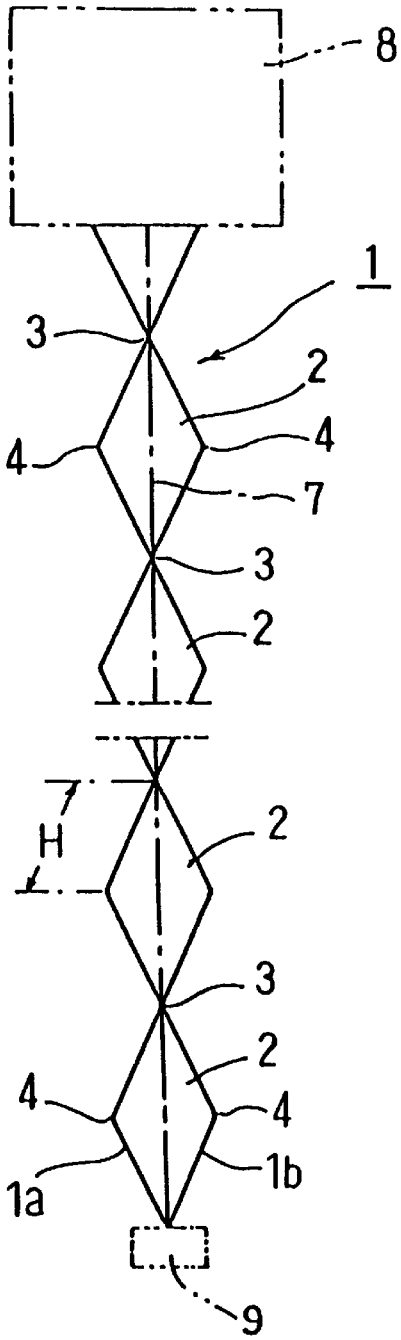
FIG. 16 is a schematic fragmentary side view showing an example in which a three-dimensional woven fabric structural material produced by said method is used as a blinds
Figure 16B:
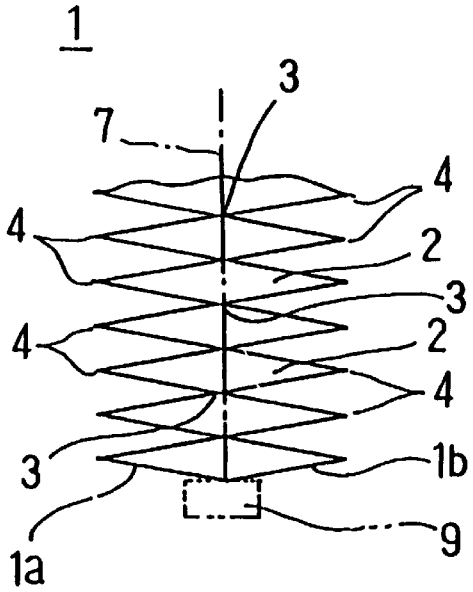

This three-dimensional woven fabric structural material 1 also, as in the case of the above embodiment, can be used for various applications, such as a cushion material, heat insulating material, noise insulating material or reinforcing core material. Further, as shown in dash-two-dot lines in FIG. 12, a flexible sheet material 11 or a rigid sheet may be placed on at least one surface to provide a composite structural material. Further, by making the cylindrical bag portions 2 expansible and foldable so that they can be folded flat, the structural material can be used as a blind or curtain as shown in FIG. 16. In this case, said auxiliary yarns 7 can be utilized for tightening purposes for folding into the juxtaposed state and/or for expansion preventing purposes.

Further, in both cases of a multi-ply weave having three- or more plies and a double weave, the three-dimensional woven fabric structural material 1 can be subjected to a resin treatment such as impregnation or coating, so as to harden the cylindrical bag portions 2 to maintain them in the predetermined hollow three-dimensional form; thus, they can be constructed in a rigid panel-like form. In this case, the three-dimensional woven fabric structural material has a high compressive strength and is superior in shape retention property, so that it can be used as a building or other structural material. Further, in the case of a structural material made of a molded synthetic resin, it may be embedded in the synthetic resin molding to serve as a reinforcing core.

Further, it is possible to apply a resin treatment to the woven fabric plies to construct it in a gas- and water-impermeable sheet form, as described above.

In addition, the pleat width H of the three-dimensional woven fabric structural material 1, that is, half the woven fabric length between the bound portions 3 can be optionally set according to the purpose and location of the use of the three-dimensional woven fabric structural material 1. For example, in the case where it is used as a curtain, blind or partition, the pleat width H is set at 5–100 mm, preferably at 10–30 mm. It may, of course, be formed in other size.

While the yarns used in the aforesaid three-dimensional woven fabric structural material 1 are not specifically restricted, it is preferable to use synthetic fiber yarns superior in heat setting property, multifilament or monofilament yarns of synthetic fibers, such as polyester fiber, nylon fiber, and aramid fiber. These yarns may be heat-set to have a suitable degree of shape retention property, so as to facilitate creasing operation.

Further, it is also possible to use glass fiber, carbon fiber, natural fibers, such as cotton fiber and wool fiber, and other fibers which are generally: regarded as incapable of heat setting. These fibers are satisfactorily used for three-dimensional woven fabric structural material whose cylindrical bag portions are not subjected to a creasing treatment to be later described.

The type and thickness of a yarn to be used or the weave can be suitably determined by making allowance for the required strength, shape retention and light shielding property. For example, yarns of several ten deniers to 8000 deniers are used and particularly for partitions-and interior decoration materials, yarns of 50–3000 deniers are used and for curtains and blinds, yarns of 50 to 500 deniers are generally used. As for the weaving density of yarns, though it differs according to the yarn thickness, preferably it is 10–150/inch per woven fabric ply for warp yarns and 10–120/inch per woven fabric ply for weft yarns. If the yarns have a greater thickness than the above-mentioned values, the weight of the three-dimensional woven fabric structural material increases, making it difficult to handle them and increase the cost. If the weaving density of yarns becomes greater than the above-mentioned values, the amount of yarn to be used increases and so does the weight, leading to high cost. If the yarn thickness or density in too low, the shape retention power becomes low, though it depends on the raw material. Therefore, yarns which come under said ranges are particularly preferable.

Figure 17A:
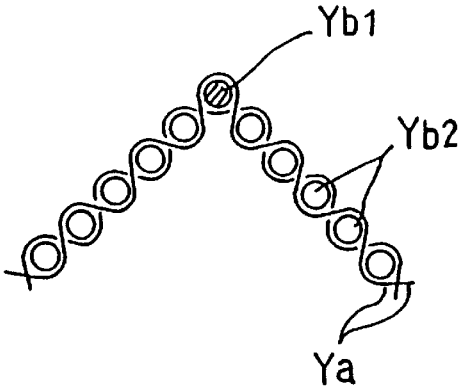
FIG. 17A and FIG. 17B are fragmentary enlarged sectional views each showing an example of a weave in which different types of weft yarns are used in creased portions.
Figure 17B:
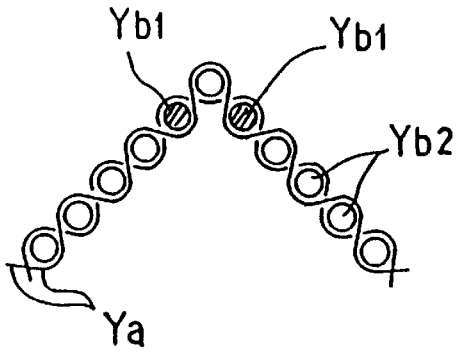
Figure 18:
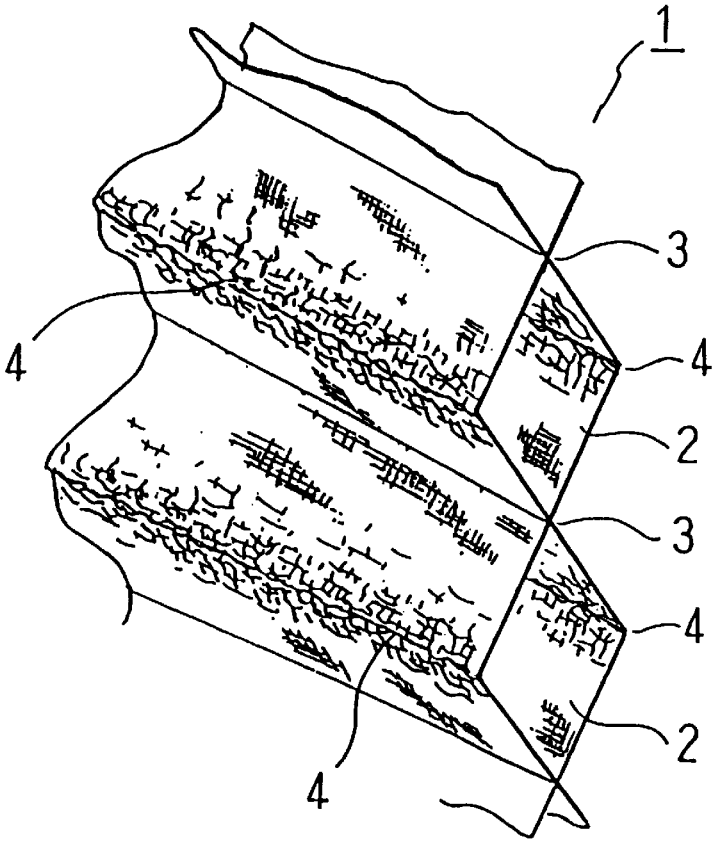
FIG. 18 is a fragmentary perspective view of a three-dimensional woven fabric structural material produced with weft yarns of high thermal shrinkage coefficient disposed in the vicinity of creased portions.

Further, in each of the embodiments using multi-ply weave having three or more plies and a two-ply weave, yarns different from others, e.g., thinner yarns or hard monofilament yarns may be inserted as weft yarns in the regions where a creasing treatment for woven fabric plies is applied, thereby facilitating the creasing operation. FIG. 17A demonstrates the case where a single weft yarn Yb1 different from other weft yarns Yb2 is used in a portion to be creased, and FIG. 17B shows the case where two weft yarns Yb1 different from other weft yarns Yb2 are used on opposite sides of a portion to be creased. And Ya denotes warp yarns.

As described above, the insertion of thin yarns or hard monofilament yarns makes the woven fabric plies easily foldable in the inserted portion, making it easier to fold the cylindrical bag portions 2 into the juxtaposed state by tightening the aforesaid auxiliary yarns 7; thus, the creasing treatment in bound portion on manufacturing process can be performed with greater ease.

It is also possible to weave such that portions to be creased are left vacant of weft yarns. In this case, creasing can be effected by heat setting alone without intentional folding into the juxtaposed state to provide a crease.

Yarns having a great heat shrinkage coefficient than weft yarns Yb2 may be used as weft yarns in the required portions of the woven fabric plies on the face and back sides, e.g., as a single weft yarn Yb1 shown in FIG. 17A or FIG. 17B or weft yarns Yb1 on the opposite sides of the portion to be creased; thus, by shrinking the weft yarns having a great heat shrinkage coefficient by a heat treatment after weaving, a shrinkage effect can be imparted to the woven fabric plies.

For example, in weaving operation, Tetoron (trade name) multifilament yarns of 100*d*/24*f* are used as warp yarns Ya and weft yarns Yb for constituting woven fabric plies, while nylon monofilament yarns of 100*d*/1*f* having a greater heat shrinkage coefficient than the first-mentioned yarns are used as a weft yarn or yarns Yb1 in said portions to be creased or in the vicinity thereof, and after weaving, the product is subjected to a heat treatment at about 100° C. or 100–150° C.

On this heat treatment, the Tetoron multifilament yarns little shrink but the weft yarns Yb1 in the form of nylon monofilament yarns have a greater heat shrinkage coefficient than the weft yarns Yb2 in the form of Tetoron multifilament yarns, so that portions having said weft yarns Yb1 woven thereinto tend to shrink, resulting in the slack of the portions having almost unshrinkable yarns. As a result, woven fabric plies on the face and back sides of the three-dimensional woven fabric structural material 1 exhibit crinkles peculiar to crepes, providing design effects and attractive features.

In addition, the weft yarns Yb1 having a greater heat shrinkage coefficient are preferably disposed in the vicinity of the portions to be creased; however, they may also be disposed in other portions of the woven fabric plies to likewise impart crepe effects to the woven fabric plies.

Further, in each of the above embodiments, hard-twist Z- and S-twist yarns whose number of twists per unit length is 1500–2500 T/m, preferably 2000 t/m, are alternately arranged one by one or in groups (e.g., two in a group) for weaving and these hard-twist yarns different in the twisting direction are used as one or both of the warp and weft yarns constituting woven fabric plies, thereby providing a three-dimensional woven fabric structural material composed of woven fabric plies, exhibiting a fine crimp-like surface touch and external appearance.

Further, unidirectional-twist hard-twist yarns and normal-twist yarns may be alternately arranged one by one or in groups for weaving and, in this case also, the woven fabric ply surface provides a crimp-like touch.

In each of the above embodiments, creased portions 4 are provided in the middle between the bound portions 3 of the cylindrical bag portions 2 on the face and back sides. However, the invention is not limited thereto, and it is possible to effect setting such that for example, as shown in FIG. 19, without applying a creasing treatment to the portion between the bound portions 3 on the face and back sides of the three-dimensional woven fabric structural material 1, it assumes an outwardly projecting round bulged form.

Figure 19A:
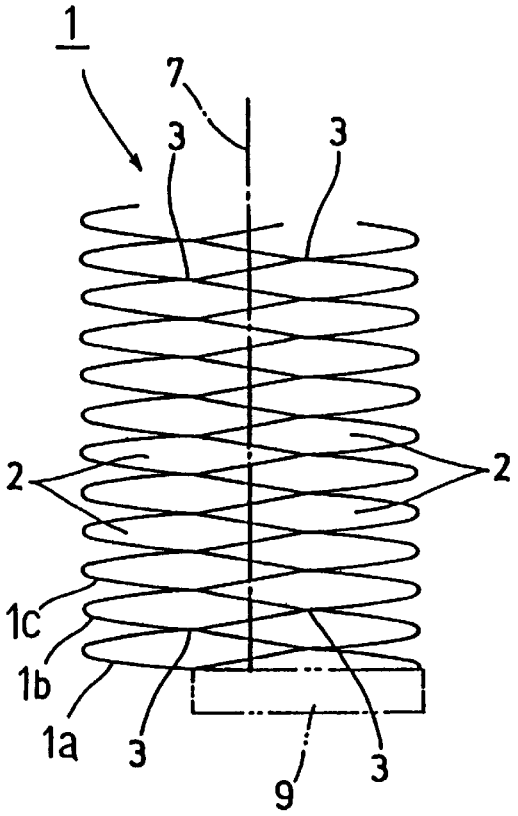
FIG. 19A and FIG. 19B are fragmentary side views, in longitudinal section, each showing an example in which three-dimensional woven fabric structural materials of other embodiments of the invention are used as a blind.
Figure 19B:
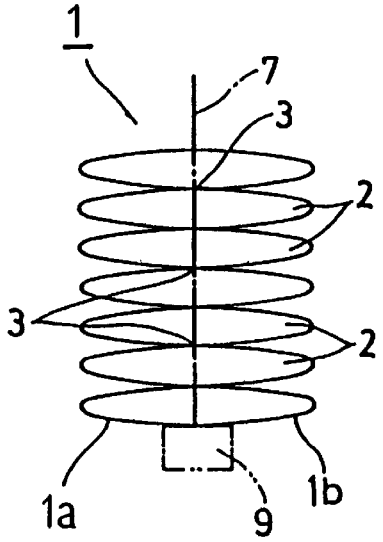

FIG. 19 shows an example in which the three-dimensional woven fabric structural material 1 is used as a curtain or blind, but since it presents a round external appearance, it also can be suitably used as a heat insulating tent or agricultural protector. In this case, each woven fabric ply can be made gas- and water-impermeable by resin treatment and a fluid such as air or water may be filled in the hollow spaces of the cylindrical bag portions 2. By filling a fluid such as air or water in the hollow spaces of the cylindrical bag portions 2, the shape retention in the installed state is improved and so is the heat insulating property, making the material suitable for use as sheet material for tents or agricultural houses. It can be easily folded into the juxtaposed state by discharging the air or the like filled therein. Of course, it can be used for various applications as in the case of the creased material.

The three-dimensional woven fabric structural material 1 in this embodiment can also be woven using auxiliary yarns 7 Which extend through the cylindrical bag portions 2 without being woven into the woven fabric plies 1*a*, 1*b*, said auxiliary yarns 7 being inserted at the opposite ends in the woven width direction and/or at predetermined intervals in the woven width direction. It is then heat-set as it is folded into the juxtaposed state shown in FIG. 19 under the tightening action of the auxiliary yarns 7, whereby the predetermined bulged shape can be maintained. Further, stretching beyond a given extent can be prevented by said auxiliary yarns 7. Other tightening strings or yarns may be provided after weaving, whereby the material can be folded into the juxtaposed state.

In this embodiment, in weaving, if yarns which have a good shape retention property or which can be hardly creased, such as yarns of glass fiber or natural fiber, are used to constitute woven fabric plies on the face and back sides, the product has good shape stability and can be maintained in a desirable substantially oval shape. In the case of this embodiment, the distance between the bound portions 3 is twice the aforesaid pleat width, that is, it is set at 10–200 mm, preferably 20–60 mm.

Next, the creasing method for converting a woven fabric of multi-ply construction into a woven fabric of three-dimensional construction will now be described with reference to FIG. 20 through 24.

Figure 20:
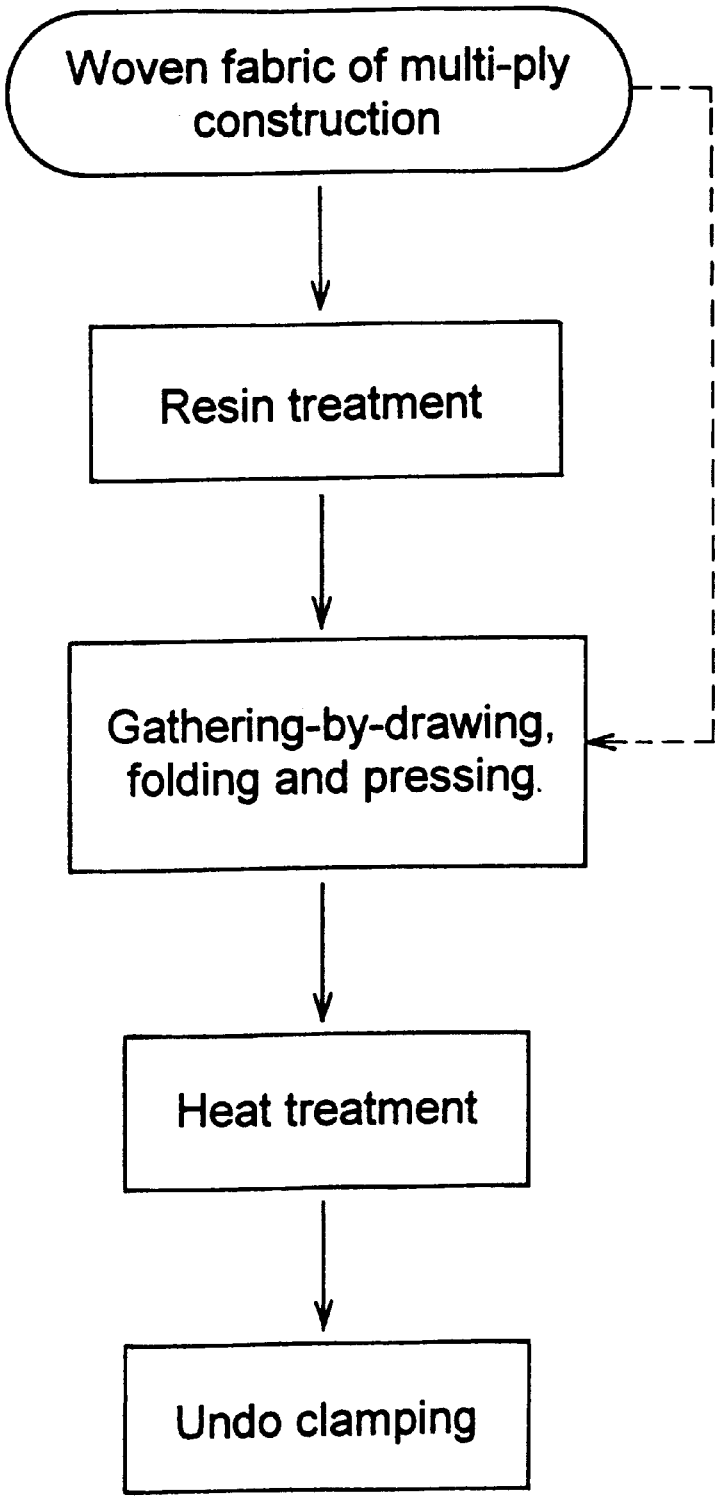
FIG. 20 is a flowchart showing the procedure for applying a creasing treatment to a woven fabric of multi-ply construction.

FIG. 20 is a flowchart showing the processing steps for the creasing operation. A woven fabric to be subjected to the creasing process is prepared by inserting auxiliary yarns 7, which are not woven, in woven fabric plies 1*a*–1*c*, as shown, e.g., in FIG. 7. In this woven fabric, the woven fabric plies 1*a*–1*c*, which alternately appear on the front and back sides, have no crease formed therein and are positioned adjacent each other, having the same sheet form as that of ordinary multi-ply woven fabrics. The length of this woven fabric is usually 30–50 m and its woven width, though varying according to uses, is usually 1.5–2.5 m.

Figure 21:
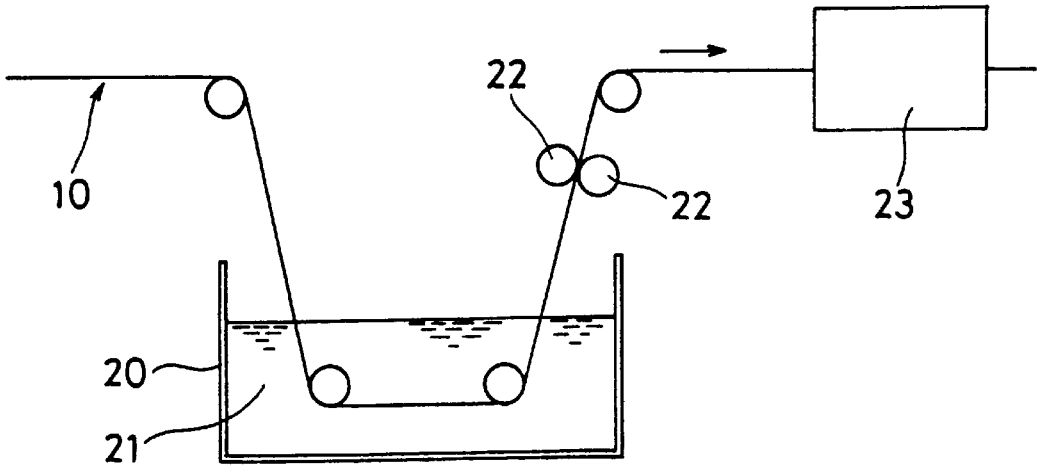
FIG. 21 is a schematic explanatory view of a resin treating process applicable to woven fabrics of multi-ply construction.

First, a resin treatment is applied to the woven fabric of multi-ply construction, for example, by dipping. This resin treatment can be applied in the same manner as in the case of ordinary woven fabrics. For example, as shown in FIG. 21, a woven fabric 10 of the multi-ply construction, while moving longitudinally, is immersed in a resin liquid 21 in a tank 20 to impregnate the woven fabric plies 1*a*–1*c* with the resin liquid. Subsequently, it is passed between squeeze rolls 22, 22 to have its adhered amount of resin controlled according to the intended object and then is subjected to preliminary drying, while suppressing the reaction of the resin, at a relatively low temperature by being passed through a drying chamber 23.

Figure 22:
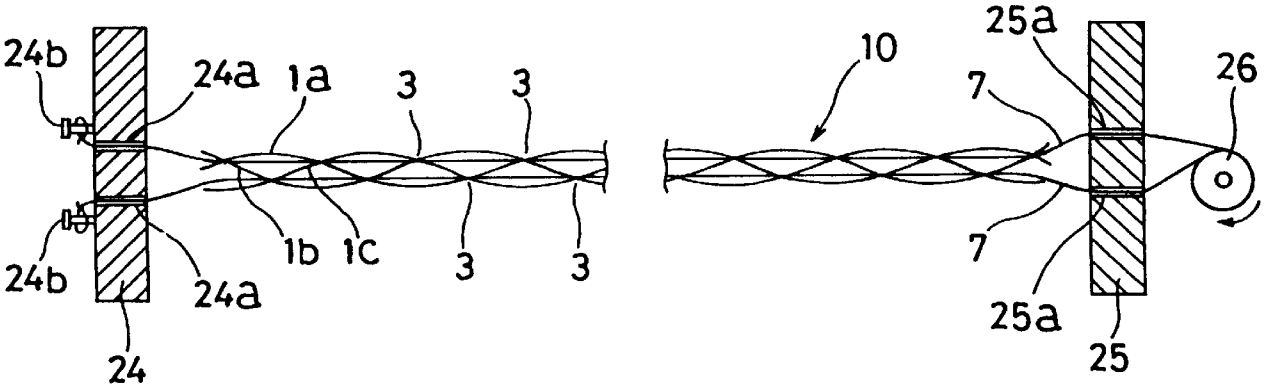
FIG. 22 is a sectional view showing the pre-gathered state in the gathering-by-drawing, folding and pressing process.
Figure 23:
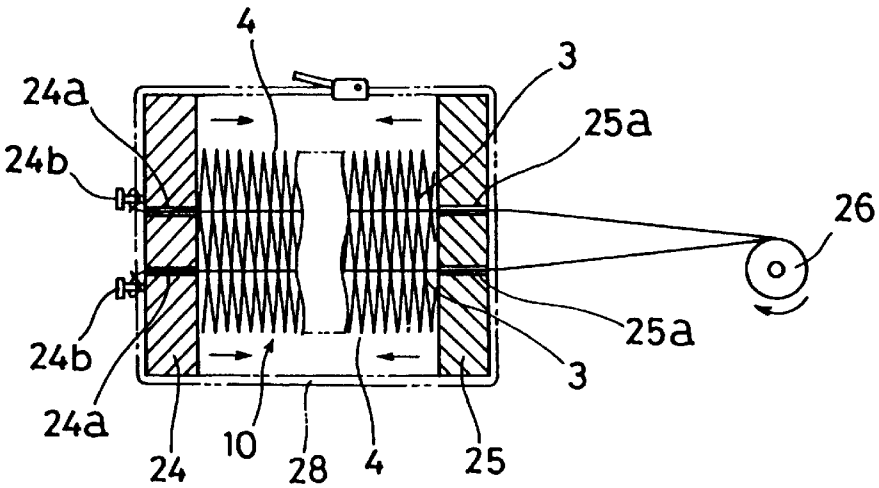
FIG. 23 is a sectional view showing the gathered state in the gathering-by-drawing, folding and pressing process.
Figure 24:
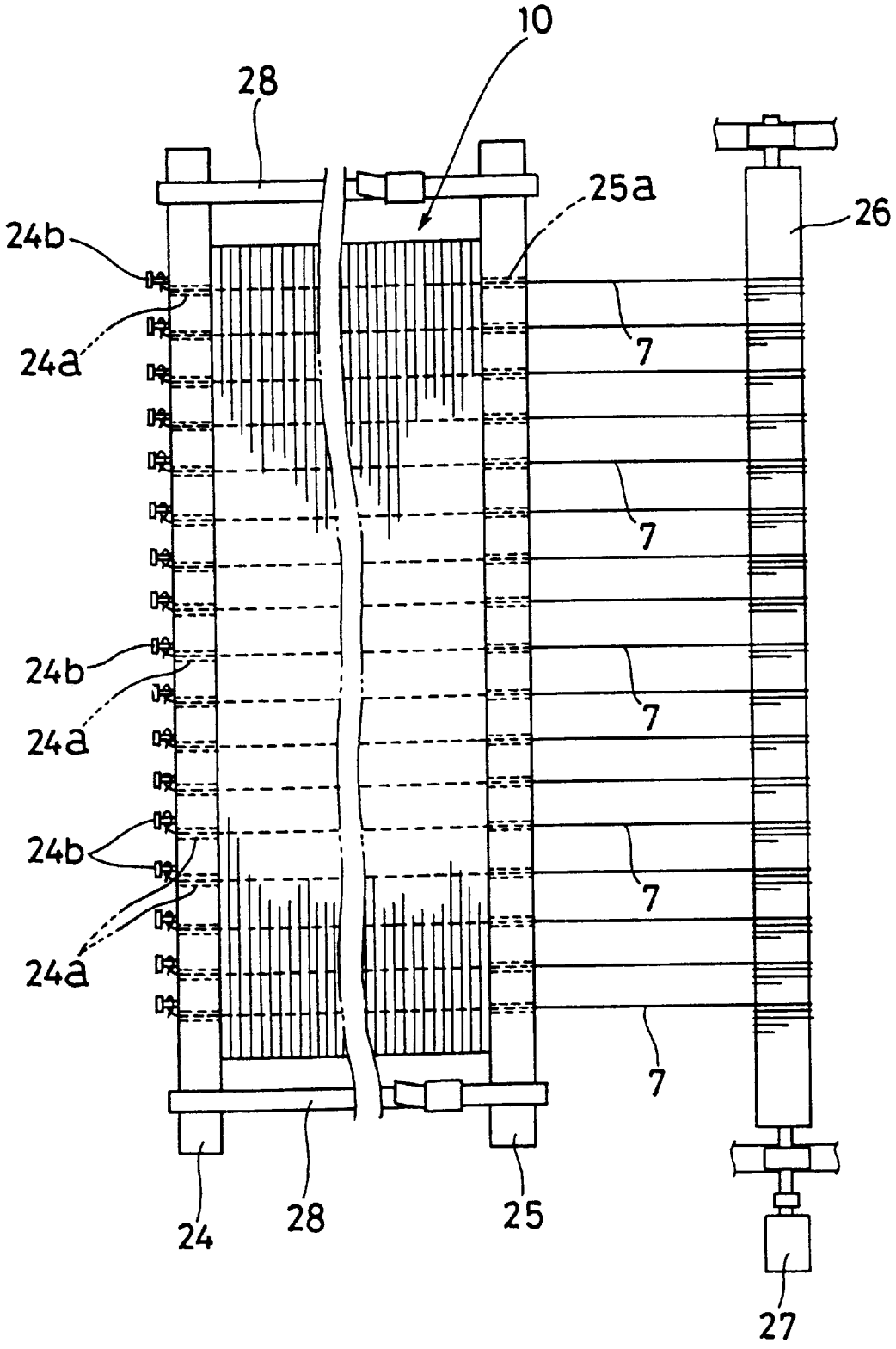
FIG. 24 is a plan view showing the gathered state in the gathering-by-drawing, folding and pressing process.

The woven fabric 10, having the resin liquid adhered thereto, is fed into a gathering-by-drawing and folding process where it is folded in such a manner as to flatten cylindrical bag portions between the bound portions of the individual woven fabric plies and is held in a pressed sate. As a folding and pressing means, use is made, as shown in FIGS. 22–24, of a clamping device comprising a pair of clamp plates 24, 25 and a roll 26 serving as a rotatably supported pulling member, and the following setting is made.

At one end of the woven fabric 10, as seen in the weaving direction, corresponding ends of the auxiliary yarns 7, which yarns are inserted along the two opposite edges spaced apart in the woven width direction and/or at required intervals (for example, at intervals of about 15 cm) spaced apart in the woven width direction, are passed into through-holes 24*a* formed in the one clamp plate 24 and tied to engaging members 24*b*, such as pins. At the other end of the woven fabric 10, as seen in the weaving direction, corresponding other ends of the auxiliary yarns 7 are passed into through-holes 25*a* formed in the other clamp plate 25 and tied to the roll 26 such that they can be wound thereon (FIG. 22).

Then, with the other clamp plate 25 thus fixed, the roll 26 which is a pulling member is rotated by drive means 27, such as a servo motor, to wind up the auxiliary yarns 7 in unison, thereby pulling the one clamp plate 24 toward the other clamp plate 25 through the intermediary of the auxiliary yarns 7, so that the woven fabric 10 is gathered to be folded by use of the auxiliary yarns 7. For this procedure, it is recommendable to provide a guide (omitted from the illustration) to enable the clamp plate 24 to move while keeping itself parallel with the clamp plate 25.

The gathering-by-drawing action causes the bound portions 3 in the woven fabric 10 to approach each other. Along with this, the individual portions of the woven fabric plies 1*a*–1*c* between the bound portions 3, 3 in the front and back surfaces are deformed to expand outward. And finally, the bound portions 3, through which the auxiliary yarns 7 are passed, overlap each other in the same position and, at the same time, the woven fabric plies 1*a*–1*c* are bent in the central position between the bound portions 3, 3 on the front and back surfaces and clamped with the cylindrical bag portions 2 held in a juxtaposed flat state (FIG. 23).

If the through-holes 24*a* and 25*a* in the clamp plates 24 and 25 are formed such that they are aligned along the auxiliary yarns 7 with woven fabric 10 in the folded state, then the folding is facilitated as described above. Further, the longer the woven fabric, the greater the force which is required to pull the auxiliary yarns 7; thus, it may be cut into suitable lengths and then folded in the manner described above.

The pull roll 26, used in the folding operation, may be replaced by a pulling member to be moved to the right as seen in the figure. Further, with the pulling member fixed in position, the other clamp plate 25 may be urged toward the side associated with the one clamp plate 24 (i.e., to the left as seen in the figure), thereby causing the auxiliary yarns 7 to draw and gather the woven fabric 10.

In the thus folded state, the clamp plates 24 and 25 are tied together by a fastener such as a fastening band 28 of rubber material, leather or steel, or a fastener utilizing a threaded bar and a nut, or other fastening means, whereby the woven fabric 10 folded in the manner described above is held clamped.

Then, the auxiliary yarns 7 are cut and, after the pull roll 26 or pulling member is removed, they are put in an oven or heating chamber for heat treatment, allowing the adhered resin to react and cure while fixing the shape of the woven fabric plies la and lb. This heat treatment, as in the case of the ordinary heat treatment or heat setting for fixing the shape of ordinary woven fabrics, can be performed by steam treatment or high temperature dry treat treatment. The heating temperature and the heating time are such that the folded woven fabric plies can be heated uniformly and sufficiently to the core, according to the type of the component yarns and the resin material. For example, in the case of using a yarn of polyester fiber as a raw material, it is heat-treated at a heating temperature of 150° C.–190° C. for 10–30 minutes.

Subsequent to the heat treatment, the clamp plates 24 and 25 are removed to undo the clamping, with the result that the woven fabric plies 1*a*–1*c* of the multi-ply woven fabric 10, folded in the manner as described above, have their shape stabilized such that they are outwardly developed at the bound portions 3 and have creases 4 at the central position between adjacent bound portions 3, 3 on the front and back surfaces. This completes the creasing operation, and thereafter, as the need arises, it is subjected to washing with water, drying and finishing.

After the completion of the creasing process, the auxiliary yarns 7 are pulled out, whereby a three-dimensional woven structural material 1 as shown in FIG. 6 is obtained, or if the auxiliary yarns 7 are left as they are, a three-dimensional woven fabric structural material 1 as shown in FIG. 10 is obtained.

In the above, the creasing process has been described with reference to the case where it is performed in combination with the resin treating process. However, in the case of a woven fabric of multi-ply construction using a synthetic fiber yarn of superior heat setting property, the resin treating process may be omitted as shown in broken line in FIG. 20, and the woven fabric, as in the above, is fed directly to the gathering-by-drawing and folding process, where the same clamping device as the above is used and the auxiliary yarns are utilized to hold the woven fabric in the folded and gathered state. The woven fabric is then put in an oven or heating chamber where it is subjected to a heat treatment at a suitable temperature for a suitable time according to the material of the woven fabric, whereby it is heat-set, stabilized in shape and creased.

In addition, the creasing treatment, resin treatment and heat treatment can be performed in the same manner as the above also in the case of the three-dimensional woven fabric structural material based on the multi-ply weave in the embodiment shown in FIGS. 1–5, and also in the case of a three-dimensional woven fabric structural material based on 2-ply weave in an embodiment shown in FIGS. 12–16.

What is claimed is:

1. A method of producing three-dimensional woven fabric structural materials, comprising the steps of:

integrally weaving at least three woven fabric plies by a multi-ply weave in a form presenting an expanded shape extending in two directions, said form presenting a front surface and a rear surface a distance between which defines a thickness, said at least three woven fabric plies being substantially parallel with one another and shifted from one another in a weaving direction so as to extend obliquely back and forth between said front and rear surfaces, a plurality of bound portions being formed each by a crossing locus of any two of said at least three fabric plies, whereby at least two rows of cylindrical bag portions are thus formed and adjacent with each other in a direction of said thickness and connected to one another through said bound portions, said cylindrical bag portions each longitudinally extending in a direction crosswise said weaving direction and said at least three rows each extending in said weaving direction, given ones of said cylindrical bag in adjacent rows being formed in staggered positions;

folding said cylindrical bag portions into a juxtaposed state in said weaving direction;

pressing said cylindrical bag portions in said weaving direction; and heat-setting said cylindrical bag portions to form creases in a position substantially midway between said bound portions in said at least three woven fabric plies on said face and back sides.

2. A method according to claim 1, wherein said at least three woven fabric plies include synthetic fibre yarns.

3. A method of producing three-dimensional woven fabric structural materials as set forth in claim 1, further comprising the steps of:

inserting prior to said step of folding, auxiliary yarns which extend through the cylindrical bag portions in the direction in which the cylindrical bag portions are interconnected in said at least two rows without being woven into said at least three woven fabric plies at at least one of opposite ends in a woven width direction and at required intervals in the woven width direction; and tightening said auxiliary yarns to accomplish said step of folding the cylindrical bag portions into the juxtaposed state in the weaving direction.

4. A method of producing three-dimensional woven fabric structural materials as set forth in claim 1, wherein said step of weaving is effected such that, at least in portions of said at least three woven fabric plies on the cylindrical bag portions on the front and rear surfaces where said creases are formed one of thin yarns and hard monofilament yarns serving as weft yarns are inserted.

5. A method of producing three-dimensional woven fabric structural materials as set forth in claim 1, wherein said step of weaving is effected such that in required portions of said at least three woven fabric plies on the front and rear surfaces, at least one yarn to be used as a weft yarn, having a greater heat shrinkage coefficient than other weft yarns of said woven fabric plies is inserted, said method further comprising the step of heat shrinking said at least one yarn having a greater heat shrinkage coefficient.

6. A method of producing three-dimensional woven fabric structural materials, comprising the steps of:

integrally weaving two woven fabric plies by a multi-ply weave in a form presenting an expanded shape extending in two directions, said form presenting a front surface and a rear surface a distance between which defines a thickness, said two woven fabric plies being substantially parallel with one another and shifted from one another in a weaving direction so as to extend obliquely back and forth between said front and rear surfaces, a plurality of bound portions being formed each by a crossing locus of said two fabric plies, whereby a row of cylindrical bag portions are thus formed and connected to one another through said bound portions, said cylindrical bag portions each longitudinally extending in a direction crosswise said weaving direction and said row extending in said weaving direction;

folding said cylindrical bag portions into a juxtaposed state in said weaving direction;

pressing said cylindrical bag portions in said weaving direction; and heat-setting said cylindrical bag portions to form creases in a position substantially midway between said bound portions in said two woven fabric plies on said face and back sides.

7. A method according to claim 6, wherein said at least three woven fabric plies include synthetic fibre yarns.

8. A method of producing three-dimensional woven fabric structural materials as set forth in claim 6, further comprising the steps of:

inserting, prior to said step of folding, auxiliary yarns which extend through the cylindrical bag portions in the direction in which the cylindrical bag portions are interconnected in said row without being woven into said two woven fabric plies at at least one of opposite ends in a woven width direction and at required intervals in the woven width direction; and tightening said auxiliary yarns to accomplish said step of folding the cylindrical bag portions into the juxtaposed state in the weaving direction.

9. A method of producing three-dimensional woven fabric structural materials as set forth in claim 6, wherein said step of weaving is effected such that, at least in portions of said two woven fabric plies on the cylindrical bag portions on the front and bear surfaces where said creases are formed, one of thin yarns and hard monofilament yarns serving as weft yarns are inserted.

10. A method of producing three-dimensional woven fabric structural materials as set forth in claim 6, wherein said step of weaving is effected such that in required portions of said at two woven fabric plies on the front and rear surfaces, at least one yarn to be used as a weft yarn having a greater heat shrinkage coefficient than other weft yarns is inserted, said method further comprising the step of heat shrinking said at least one yarn having a greater heat shrinkage coefficient.

* * * * *